United States Patent [19]

Mol

[11] 4,146,215

[45] Mar. 27, 1979

[54] HORIZONTAL COLLATOR-SORTER

[75] Inventor: Hans C. Mol, Wilton, Conn.

[73] Assignee: Pitney-Bowes, Inc., Stamford, Conn.

[21] Appl. No.: 790,348

[22] Filed: Apr. 25, 1977

[51] Int. Cl.[2] ..... B65H 39/055

[52] U.S. Cl. ..... 270/58; 271/173

[58] Field of Search ..... 270/58, 52; 271/64, 271/173

[56] References Cited

U.S. PATENT DOCUMENTS

| | | | |
|---|---|---|---|
| 3,580,563 | 5/1971 | Bassett | 270/58 |
| 3,685,819 | 8/1972 | Deutsch | 271/173 |
| 3,708,160 | 1/1973 | Kantarian | 270/53 |

*Primary Examiner*—Edgar S. Burr
*Assistant Examiner*—A. Heinz
*Attorney, Agent, or Firm*—Martin D. Wittstein; Albert W. Scribner; William D. Soltow, Jr.

[57] ABSTRACT

A sheet handling machine having the dual capability of either collating or sorting sheet material into individual booklets or collations. The machine has a plurality of sheet receiving bins operatively associated with infeed and outfeed locations of the machine, and a conveyor system for moving sheets between the infeed and outfeed locations in a predetermined sequence. The machine includes movable deflectors for deflecting sheets from the conveyor means into the bins, and feeding means located in the bins for feeding sheets from the bins back into the conveyor system. Appropriate controls are provided to cause the deflecting means or the feeding means to be selectively operable in a predetermined sequence. In a sorting mode of operation, successive copies of the first page of a booklet are fed into successive bins until each bin contains one copy. Thereafter, successive copies of each successive page of the booklet are fed into each bin until each bin contains a completed booklet. Thus, as many booklets are simultaneously formed as there are bins. In the collating mode, each bin is automatically loaded with a predetermined number of the same page of the booklet, and a single sheet from each bin is ejected and conveyed to a receiving station to form a single completed booklet.

12 Claims, 17 Drawing Figures

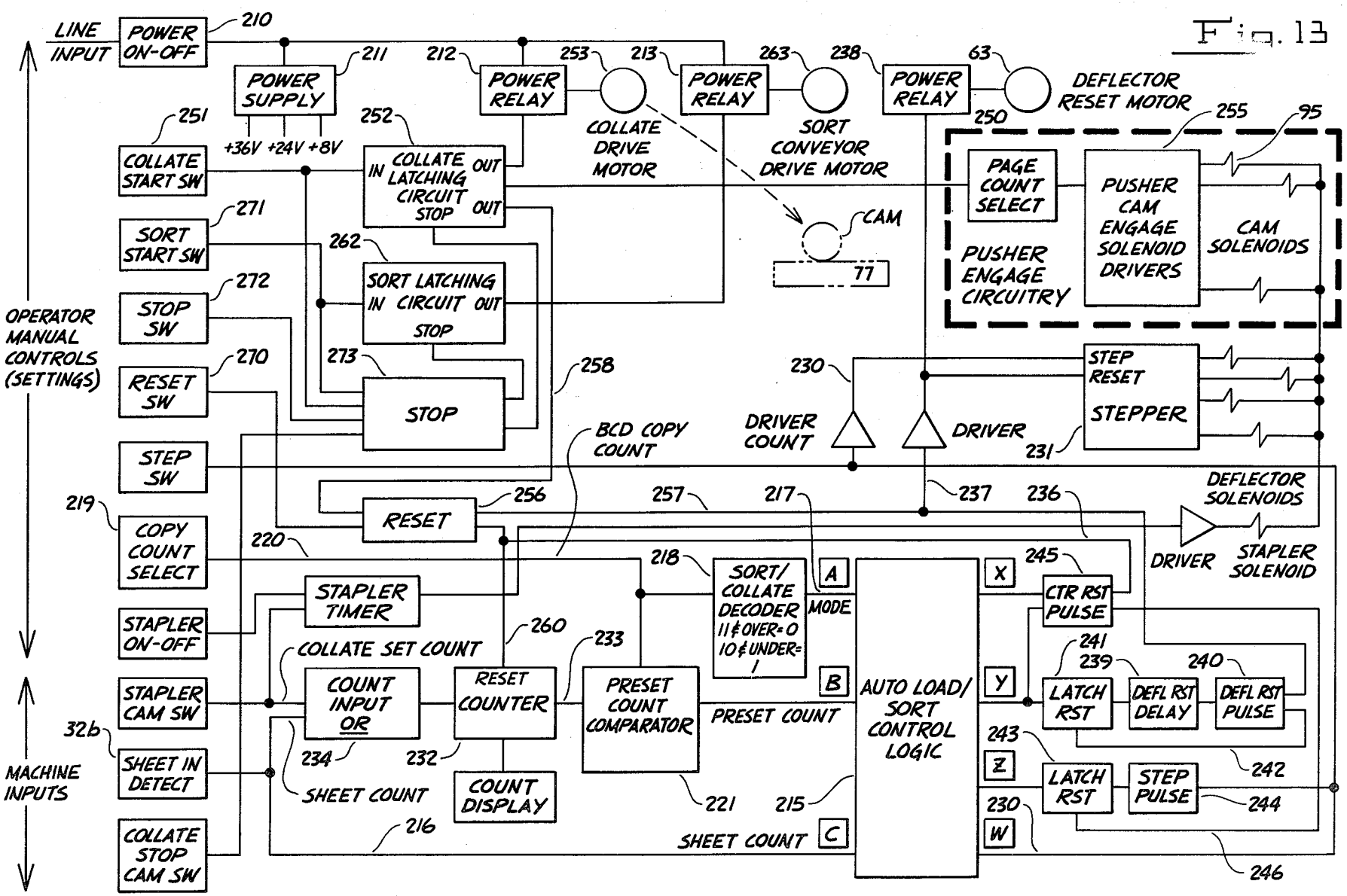
Fig. 13
95
CAM SOLENOIDS
255
PUSHER CAM ENGAGE SOLENOID DRIVERS
PAGE COUNT SELECT
PUSHER ENGAGE CIRCUITRY
DEFLECTOR RESET MOTOR
63
250
POWER RELAY
238
SORT CONVEYOR DRIVE MOTOR
263
POWER RELAY
213
COLLATE DRIVE MOTOR
253
POWER RELAY
212
211
POWER SUPPLY
+36V +24V +8V
210
POWER ON-OFF
LINE INPUT
CAM
77
STEP RESET
STEPPER
231
DRIVER
230
DRIVER COUNT
DEFLECTOR SOLENOIDS
STAPLER SOLENOID
DRIVER
236
237
217
257
218
258
BCD COPY COUNT
256
COLLATE IN LATCHING CIRCUIT OUT STOP
252
SORT LATCHING IN CIRCUIT OUT STOP
262
STOP
273
RESET
220
COLLATE START SW
251
SORT START SW
271
STOP SW
272
RESET SW
270
STEP SW
COPY COUNT SELECT
219
STAPLER ON-OFF
STAPLER CAM SW
SHEET IN DETECT
326
COLLATE STOP CAM SW
OPERATOR MANUAL CONTROLS (SETTINGS)
MACHINE INPUTS
CTR RST PULSE
245
241
239
LATCH RST
240
DEFL RST DELAY
DEFL RST PULSE
242
244
STEP PULSE
LATCH RST
243
230
246
X
Y
Z
W
AUTO LOAD/ SORT CONTROL LOGIC
A
B
C
MODE
SORT/ COLLATE DECODER 11 & OVER = 0 10 & UNDER = 1
PRESET COUNT
215
SHEET COUNT
221
PRESET COUNT COMPARATOR
233
260
RESET COUNTER
COUNT DISPLAY
232
216
STAPLER TIMER
COLLATE SET COUNT
COUNT INPUT OR
234
SHEET COUNT

| LINE | INPUTS | | | OUTPUTS | | | |
|---|---|---|---|---|---|---|---|
| | A | B | C | W | X | Y | Z |
| 1 | 0 | 0 | 0 | 0 | 0 | 0 | 0 |
| 2 | 0 | 0 | 1 | 0 | 0 | 0 | 1 |
| 3 | 0 | 1 | 0 | 0 | 0 | 0 | 0 |
| 4 | 0 | 1 | 1 | 0 | 1 | 0 | 1 |
| 5 | 1 | 0 | 0 | 0 | 0 | 0 | 0 |
| 6 | 1 | 0 | 1 | 1 | 0 | 0 | 0 |
| 7 | 1 | 1 | 0 | 0 | 0 | 0 | 0 |
| 8 | 1 | 1 | 1 | 1 | 1 | 1 | 0 |

| INPUT | OUTPUT |
|---|---|
| BCD 10 AND UNDER | 1 |
| BCD 11 AND OVER | 0 |

HORIZONTAL COLLATOR-SORTER

BACKGROUND OF THE INVENTION

1. Field of the Invention

The arts of sheet collating and sorting are well known arts that have been practiced for a very long time. A vast amount of technology has been developed, and many machines have been designed for arranging sheets of paper in a predetermined orderly fashion. With the development of fully automatic high speed printing machines, and the more recent advent of high speed copying and/or duplicating machines, there has been a steadily increasing demand for collating and sorting machines which are compatible with the large variety of printing, copying or duplicating machines presently available.

In order to better understand the development of the prior art in the above field, as well as the existing necessity for the present invention, one should have a basic understanding of the distinction between sorting and collating even though these terms have not been universally accepted as designations for the respective sheet handling methods hereinafter described. Generally speaking, in a machine in which a predetermined number of bins are to be utilized, the term sorting designates a method of sheet handling in which a plurality of successively identical sheets are fed into the predetermined number of bins until each bin contains one sheet, for example, page 1 of a twenty page booklet. Thereafter, another plurality of successively identical sheets are fed into the bins until each bin contains one of the second plurality of sheets, for example, page 2 of the twenty page booklet. This method of loading the bins is continued until each bin contains one copy of each of the twenty pages of the booklet in sequential order, so that at the end of the operation each bin contains a completed booklet. If ten bins are utilized, ten booklets will be simultaneously formed each having twenty sheets. Typically, in prior art sorting machines, notwithstanding the advantage of the sorting machine having on-line capability with a copying or duplicating machine, the completed booklets or collations must be removed at this time from the machine by hand, and the pages of each booklet are fastened together by any suitable means. Such means include conventional stapling, either by a manual operation or by feeding the booklet into an automatic jogging and stapling machine of which a variety of such machines are commercially available.

In the method of collating, a machine having a plurality of bins is preloaded with a predetermined number of identical sheets. After the bins have been loaded, a feeding means associated with each bin, ejects one sheet at a time from each bin in order to form a collation (booklet) containing the desired number of sheets. In this mode of operation, each collation is formed individually, rather than all collations formed simultaneously. This is because the sheets are ejected from the bins in the same order as the numerical order of the pages that form the collation for each cycle of operation of the machine. Thus, for example, if it is desired to generate fifty booklets each having ten pages, each of ten bins is preloaded with fifty copies of a page of the booklet. The feeding means associated with each bin then operates to eject the ten pages, either simultaneously or successively, so that during one operating cycle of the machine, ten pages in numerical order are delivered to a receiving station. Thus, the fifty booklets are formed by running the machine through fifty cycles of operation in the above manner.

Notwithstanding the disadvantage of the requirement for hand loading typical prior art collating machines, one of the advantages of these prior art collating machines was the capability of automatically finishing each booklet as it is formed by placing any of a variety of stapling or stitching machines which are commercially available on-line with the collator.

It will thus be seen that the sorting technique is most efficiently utilized when it is desired to generate a small number of booklets each having a large number of pages, whereas the collating technique is most efficiently utilized when it is desired to generate a large number of booklets each having a small number of pages.

Another convenient way of easily recognizing the distinction between sorting and collating is to consider that in sorting the number of bins equals the number of booklets which can be formed regardless of the number of pages, and in collating the number of bins equals the number of pages in each booklet regardless of the number of booklets which are being formed.

In the methods described above, the sorting and collating machines are each illustratively chosen to have 10 bins available to hold 50 sheets of paper. With a sorting machine, the sorting technique would be selected to form a maximum of 10 booklets of 50 pages each. With a collating machine, the collating technique would be used to form a maximum of 50 booklets each having 10 pages.

Statistical analysis from typical in-plant duplicating rooms, commercial print shops, quick copy centers and other facilities in which a large volume of copying is carried out, reveals that the above chosen numbers of booklets and pages is representative of the vast bulk of individual operations carried out in the copying and duplicating field. This indicates that the prior art should have developed along the lines of a large variety of sorting and collating machines in the 10 bin range, or perhaps in the 10 to 20 bin range. Although some sorting and most collating machines have a number of bins within this range, the development of the prior art, and the commercial availability of products, has been directed more towards machines having a large numbers of bins, particularly so in the case of sorting machines. These machines are, of course, very complex in construction and operation, and highly sophisticated in the manner in which they can be programmed to generate multiples of booklets in a single operating cycle. They are also extremely expensive. All of these factors tend to make these machines attractive only to operators of very large commercial duplicating centers, or to print shops which handle extremely large volume jobs, e.g. 100 or more pages per booklet for a collating operation or many thousands of booklets having a relatively small number of pages for a sorting operation. The result of this situation, is that the average user of sorting and collating machines does not have freedom of choice to choose the best method of paper handling conducive to the size and number of booklets which he desired to form. The user must of necessity purchase both a sorting machine and a collating machine from such machines commercially available in the 10 to 20 bin range, or he must purchase either a larger collating machine or a larger sorting machine and use either machine efficiently for only one type of booklet formation and very inefficiently for the other type of booklet formation for which it wasn't designed. His only other choice is to farm out his sorting and/or collating jobs to outside print shops which can afford to maintain the necessary number and size of machines to handle all types of jobs. Of course, all of the aforementioned alternatives result in the individual paying a higher per unit cost for smaller jobs.

The present invention, as will be more fully appreciated hereinafter, is directed to the provision of a combined sorting and collating machine. The invention provides the capability of performing both of the above described sheet handling methods in a single machine, whose bin capacity is within the above enunciated range most suitable for the average user of sorting and collating equipment. The combined sorting and collating machine of the present invention will handle any sorting job in which the number of booklets to be formed is limited to the number of bins available (the number of pages per booklet being limited only by the sheet capacity of the bins). The machine will also handle any collating job in which the number of pages in each booklet is limited to the number of bins in the machine (the number of booklets which can be formed being limited only by the sheet capacity of each bin). It will be apparent that the machine of the present invention will meet all of the sorting and collating requirements of users within the range statistically determined to cover the vast bulk of such users.

Another advantage with this type of machine is that if the machine is constructed with relatively large bins, it can be used in a sorting mode to form booklets having an extremely large number of pages, and can be used in a collating mode to form an extremely large number of booklets. This advantage is helpful for those occasional situations where a sorting or collating run extends beyond the range of a normal (average) run.

A still further significant advantage of the combined sorting and collating machine of the present invention is its capability of automatically loading sheets for the collating mode. The machine is operated in a semi-sorting mode in which identical sheets are loaded into the same bin, and successions of subsequent sheets are each loaded into respective ssuccessive bins. The resulting procedure provides an automatic loading of the machine which will thereafter be operated in a collating mode.

2. Prior Art

As previously mentioned, there are a few machines in the prior art which have a number of bins within the range of the number of bins in the machine of the present invention. One such machine is disclosed in invention. One such machine is disclosed in U.S. Pat. Nos. 3,580,563 and 3,773,313, both issued to Ernest D. Bassett on May 25, 1971 and Nov. 20, 1973, respectively. These a horizontal array of substantially vertically opening bins. Feeding means associated with each bin eject individual sheets from a stack of sheets contained in each bin, for the purpose of forming a collation of ejected sheets. Thus, by the definitions given above, this machine is a collator. The machine also includes a relatively complicated system of manually adjustable baffles which, in cooperation with a sheet conveyor, function to feed sheets from the conveyor into the individual bins. When the conveyor is run in a reverse direction from the direction in which it is run during normal collating, the bins of the machine can be automatically loaded prior to performing a collating operation. Thus, the machine disclosed in these patents is essentially an automatically loading collator.

The significant deficiency of the machine disclosed in these patents, and therefore the significant distinction between the machine of the present invention and that disclosed in the patents, is that no provision whatever is made for operating the prior art machine in a sorting mode. The Bassett machine is devoid of any concept or structure which would allow, or even facilitate with modification, the sorting operation to be carried out in this machine.

Another significant deficiency in the Bassett machine is that the only provision for ingress and egress of sheets to and from the machine is at one end thereof, which renders it particularly difficult to use the machine on-line with a copying or duplicating machine. As previously described, a significant advantage of any sorting machine is that it can be used on-line with a copying or duplicating machine, so as to sort the successive copies of the same document into different bins, and repeat the operation with successive documents. In sharp contrast to this deficiency, the machine of the present invention at least in the preferred embodiment, provides for ingress of sheets at one end of the machine and egress of sheets at the other end, so that the machine can be operated on-line with a copier or duplicator. The inventive machine can thereby perform a sorting function in a most efficient manner. A corollary advantage of this construction over Bassett, is that by appropriate manipulation of the baffles and baffle controls which operate one way in a sorting mode operation, the machine of the present invention can also be operated to automatically load the bins preparatory to a collating operation. This is in lieu of manually loading the bins prior to the collating operation.

Thus, the machine of the present invention is so designed and constructed to perform functions neither contemplated nor possible with the prior art machine. The machine of the present invention also performs the same functions as those of the prior art machine with much less complicated structure, and in a more efficient manner. The invention achieves this, while at the same time achieving greater versatility and having provisions for automatic changeover from one mode of operation to another. This the prior art machine cannot accomplish.

SUMMARY OF THE INVENTION

The present invention relates generally to a sheet handling apparatus, and more particularly to a combined sorting and collating machine which can be operated selectively to organize printed sheet material by either sorting or collating techniques.

The sorting and collating machine generally comprises a means defining a sheet infeed location and a sheet outfeed location. Operatively associated with these locations is a plurality of adjacent sheet receiving and storing bins. A conveyor means is operatively associated with the plurality of bins, for conveying sheets seriatim from the infeed location to the plurality of bins, and for conveying sheets from the plurality to the outfeed location. A movable sheet deflecting means is disclosed between the conveyor means and the bin for deflecting sheets from the conveyor into the bins. A sheet feeding means is operatively associated with each of the bins for ejecting sheets from the bins to the conveyor means for delivery of the ejected sheets to the outfeed location of the machine.

The machine includes a first control means for actuating the sheet deflecting means in such a manner as to cause the sheet deflecting means to deflect successive sheets from the conveyor means into a preselected one or more of the plurality of bins. A second control means is provided for actuating the sheet feeding means to cause the sheet feeding means to eject sheets in a selectable succession from the bins to the conveyor means. There is also a selector means operatively associated with both the first and second control means in order to be able to select which of the first or second control means is operable in order to respectively control the deflector means and/or the sheet feeding means in a desired mode of operation for the machine.

In the preferred embodiments of the invention, the plurality of sheet receiving and storing bins are arranged as a substantially horizontal array of substantially vertically oriented, adjacent bins. The conveyor means is in the form of a conveyor belt disposed adjacent the horizontal array of bins. In one form of the invention there is a first conveyor belt extending from the infeed end of the machine along the horizontal array of bins, and a second conveyor belt disposed adjacent the horizontal array of bins at another end of the bins. The sheets are fed into the bins from one end, and are fed out of the bins at the other end. The deflector means can either be in the form of individual deflectors mounted adjacent the infeed end of each bin, and are sequentially operated to deflect sheets into successive bins, or can be a single deflector which moves from bin to bin in succession, to accomplish the same purpose. The sheet feeding means is preferably in the form of individually operable roller feeding devices, or sheet pushing devices mounted within each bin. Each is individually operable to eject sheets from the bins in a preselected order.

Having briefly described the general nature of the present invention, it is a principal object thereof to provide a combined sorting and collating machine.

It is another principal object of the invention to provide a combined collating and sorting machine that will automatically load sheets preparatory to operating the machine in a collating mode.

It is another object of this invention to provide a combined collating and sorting machine in which the sheet conveying and storing components are arranged to facilitate the collating and storing machine being placed on line with one or both of a duplicating machine and a set finishing machine.

It is another object of this invention to provide a collating and sorting machine which provides for automatic unloading of stacks of sheets from the storage bins after completion of a sorting operation so that the stacks of sheets can be fed directly to a set finishing machine.

It is another object of this invention to provide a collating and sorting machine in which the same sheet deflecting elements are utilized for both sorting and automatic loading preparatory to collating and which utilizes electronic controls to cause operation of the machine in a preselected mode of operation.

It is another object of this invention to provide a collating and sorting machine which is relatively simple in construction, is easy to operate and maintain and provides greater flexibility than heretofore possible with prior art collating machines or sorting machines.

These and many other objects of this invention, will become more apparent and will be better understood with reference to the following detailed description taken in conjunction with the accompanying drawings, in which.

Figures 13A, 13B:
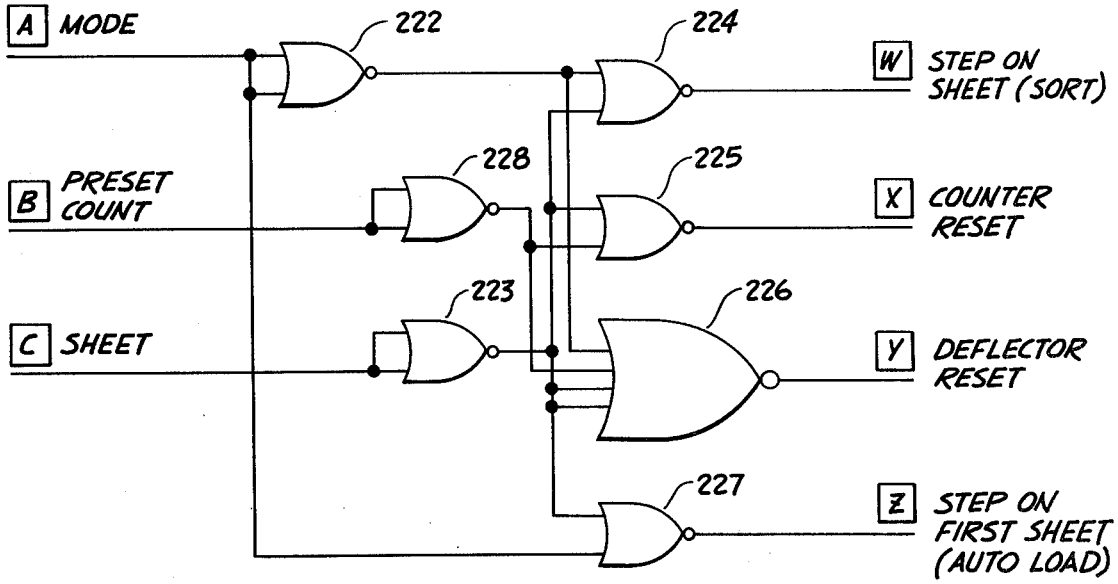
FIG. 13 is an electrical diagram for the invention of FIG. 2.

FIG. 13*a* is a detailed electrical schematic of the auto load/sort control logic shown in FIG. 13;

FIG. 13*b* is a truth table for the auto load/sort control logic depicted in FIG. 13*a;*

Figures 13C, 13D:
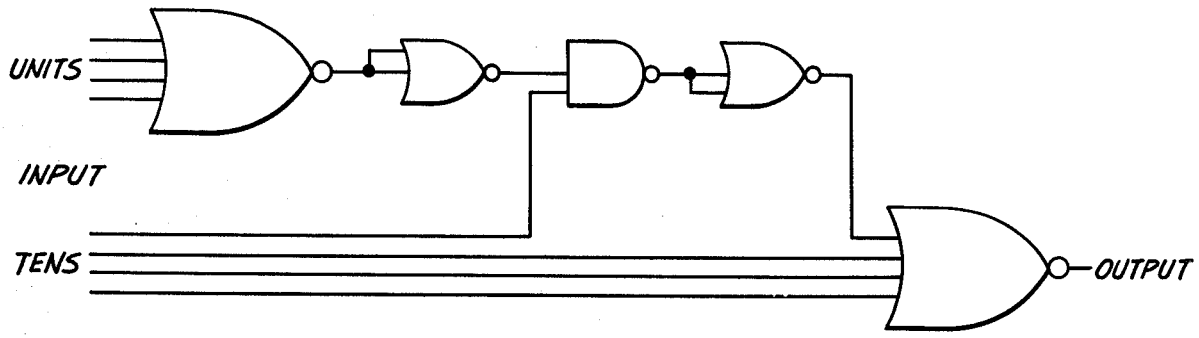

FIG. 13*c* is a schematic view of the sort/collate decoder circuit illustrated in FIG. 13; and FIG. 13*d* is a truth table for the sort/collate decoder circuit depicted in FIG. 13*c*.

DETAILED DESCRIPTION

Figure 1:
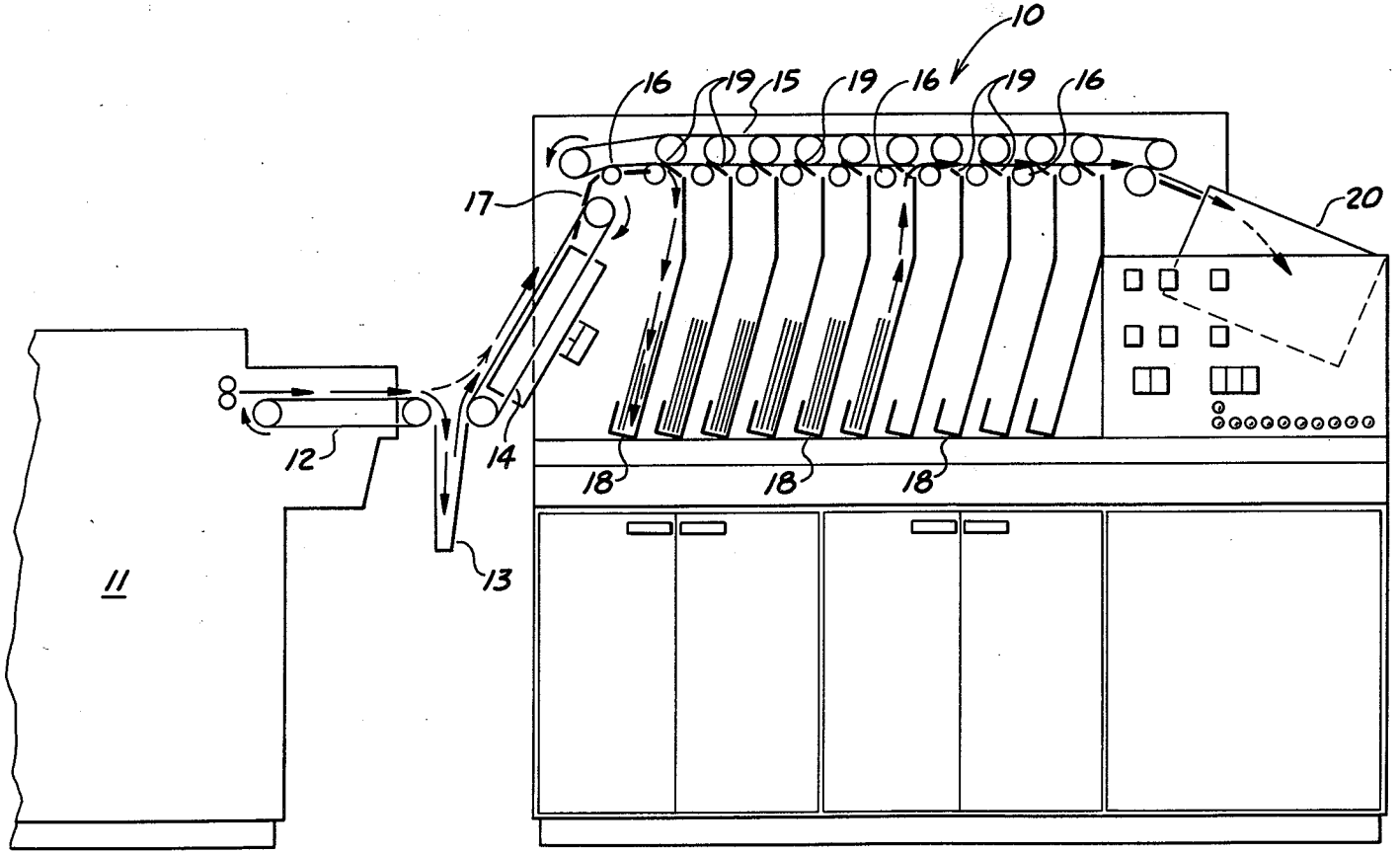
FIG. 1 is a schematic side view of the combined collator-sorter of this invention depicted in situ with a copier machine.

Now referring to FIG. 1, a combination collating and sorting apparatus of this invention is schematically and generally shown by arrow 10. The collating and sorting apparatus 10 will be referred to hereinafter as a "COLLATOR-SORTER", for the sake of brevity. The "collator-sorter" receives sheets of printed material from a printer or copier machine 11. The sheets are conveyed from the copier machine 11 via conveyor 12 to a reversing device 13, for turning the sheet over to its reverse side. This reversing device 13 is an optional apparatus and can be bypassed by suitable controls (not shown). The need for reversing the printed sheet material is dependent upon the mode of operation, i.e. collating or sorting, and whether the first or last sheet of a booklet of sheets, is to be the first sheet fed in the series of sheets fed from the copier 11. Also, the copier or printing device may introduce the printed sheet face up, or face down, thus, necessitating in certain instances, a need for reversing the document.

If the reversing device 13 is bypassed, the sheet material will be directly transported from conveyor 12 to conveyor 14. Conveyor 14 will introduce the printed sheet material into the bite between an overhead conveyor belt 15 and the first of several transfer rollers 16. A guide plate 17 is provided to steer the sheet into this bite.

The collator-sorter 10 is comprised of an array of bins 18 for receiving the sheet material. The first bin 18 (lefthand side) is diagrammatically shown in a sheet receiving condition. The second through fifth bins 18 (from the left) are already shown in a sheet loaded condition.

A number of deflector arms 19 direct the sheet from the conveyor belt 15 to the bins 18. The deflector arms 19 are individually controlled so that an incoming sheet may be fed directly to any bin in the array.

In a collating mode, sheets that have been deposited in the bins are ejected and conveyed to the rear of the collator-sorter as typically illustrated by the sixth bin from the left. When sheet materials are ejected out the top of the bins 18, the deflector arm 19 for the respective bin must be moved to a non-interfering position, i.e. moved from the deflecting position. This is necessary to allow the sheet to clear the top of the bin. The conveyor belt 15 will now be activated to convey the sheets to a stacking bin 20 or other depository. The booklets can be offset, stapled, stitched or finished in standard ways known in the art.

One of the nice aspects of the present system, is that the collator-sorter 10 is not limited to "on-line" operation, i.e. it can operate independently of any external equipment or "hook-ups". In other words, the collasorter 10 can be both automatically or manually operated. The capabilities of the machine can be utilized with a "hand marrying" of sorted sheet materials to extend its range of effectiveness. Also, the collator-sorter can be hand loaded with sheets from other sources than with sheets fed from the copier or duplicator 11.

Figure 2:
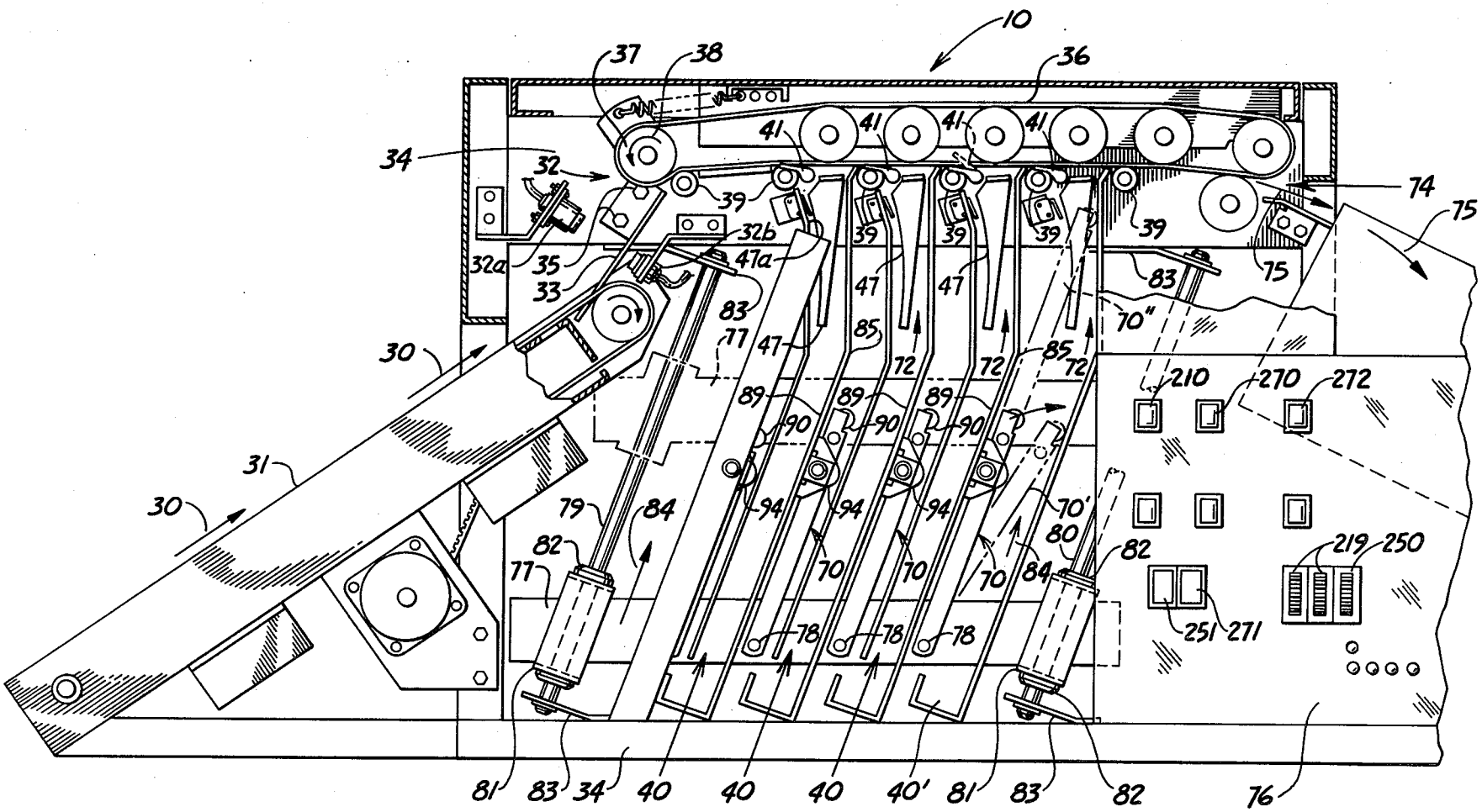
FIG. 2 is a detailed side view of the combined collator-sorter shown in FIG. 1.

Referring to FIG. 2, a detailed view of the collator-sorter 10 of FIG. 1 is shown. Sheets from a duplicating device are conveyed (arrows 30) along the conveyor belt 31. The sheets are guided to an infeed inlet, shown generally by arrow 32. The sheets are guided to the inlet 32 by a guide plate 33, which is secured to a main frame 34 by bolt fasteners 35.

An overhead belt conveyor 36 supported by frame 34, is driven by a drive roller 37 as shown by arrow 38. Below the overhead conveyor belt 36 are disposed a series of rollers 39, which cooperate with the overhead conveyor to form a transporting bite for incoming sheet materials. Each of the rollers 39 are rotatively carried upon frame 34 via shafts 48, and are caused to rotate as the conveyor 36 is driven.

Below the rollers 39 is disposed an array of sheet receiving bins 40. The number of bins 40 in the array can be any reasonable or suitable number consistent with the overall use objectives or design capacity. In any event, because the collator-sorter provides a dual capability, the design needs (number of bins) can be generally less, thus allowing for a more compact machine.

The sheet material is deflected into the proper bin 40 by means of individual deflectors 41 disposed adjacent each of the rollers 39. For a more detailed view of the deflectors 41, reference should also be made to FIG. 3. Each deflector 41 is comprised of a series of fingers 42 (FIG. 3) that nest in slots 29 of roller 39. The fingers 42 are pivotably secured to shaft 43, which when rotated (arrow 44) will pivot the deflector fingers 42 upwardly (arrow 45). In the upward position, fingers 42 will cause a moving sheet (arrow 46) of paper to be deflected downwardly into a respective bin 40.

A contoured guide member 47 (FIG. 2) is also useful to direct the sheet material downwardly into the bin. The guide member 47 can be suitably secured to the frame 34.

Shafts 43 are individually rotated (arrow 44) by means of respective solenoid actuated linkages 49. An "L"-shaped flange member 50 is secured to each deflector shaft 43. A spring 51 secured to a frame supported pin 52, biases the flange 50 and the shaft 43 to rotatively pivot in the direction of arrow 44, when flange 50 is free to move. Flange 50, however, is normally held against movement by a lip 53 disposed on pivotable link 54. Link 54 is pivotable (arrow 56) about pivot 55. When so pivoted, link 54 will allow the flange 50 to pull free of lip 53, under the influence of spring 51. A plunger 58 of a spring-loaded pull solenoid 57 is pin-connected to link 54 via slot 59 in the link. When a respective solenoid 57 is actuated, its plunger 58 will pull downwardly (arrow 60) upon its respective link 54, thus freeing flange 50. Flange 50, and hence shaft 43, will then rotate (arrow 44). This will cause the deflector 41 to move upwardly (arrow 45) into a sheet deflecting position, as aforementioned.

When all the deflectors 41 are to be reset to a non-deflecting position, a slide bar 60 is pulled to the left (arrow 61). Adjacent each of the flanges 50, is a pin 62, which is affixed to the slide bar 60. When the slide bar 60 is moved to the left, pins 62 will cam all the flanges 50 back into engagement with lip 53. In this position, the deflectors 41 will be held in a non-deflecting position until their respective solenoids 57 will be activated.

The slide bar 60 is moved under the influence of aa single revolution motor 63, a cranking disc 64, and a pivoting arm 65. The cranking disc 64 is rotatively attached, via shaft 66, to the motor 63. When the motor 63 is actuated, the disc 64 will be made to turn (arrow 67). Arm 65 which is pivotably connected to the disc 64 by pin 68, will be imparted with a slider-crank motion. Arm 65 is connected to slide bar 60 via pin 69. The slide bar 60 will be moved to the left and back to an initial position, under the influence of arm 65. Slide bar 60 is slidably mounted with respect to frame 34 and roller shafts 48.

After the sheet material has been deposited into their respective bins, the collator-sorter 10 may be run as a collator by automatically actuating the one revolution motor 63 to return the deflectors 41 to a non-deflecting position. Conveyor 36 (FIG. 2) is actuated and the sheets are ejected from bins 40 by means of ejecting arm pushers shown generally by arrows 70. The ejecting pusher arms 70 will be explained with reference to FIGS. 2, 4 and 5.

Figure 5:
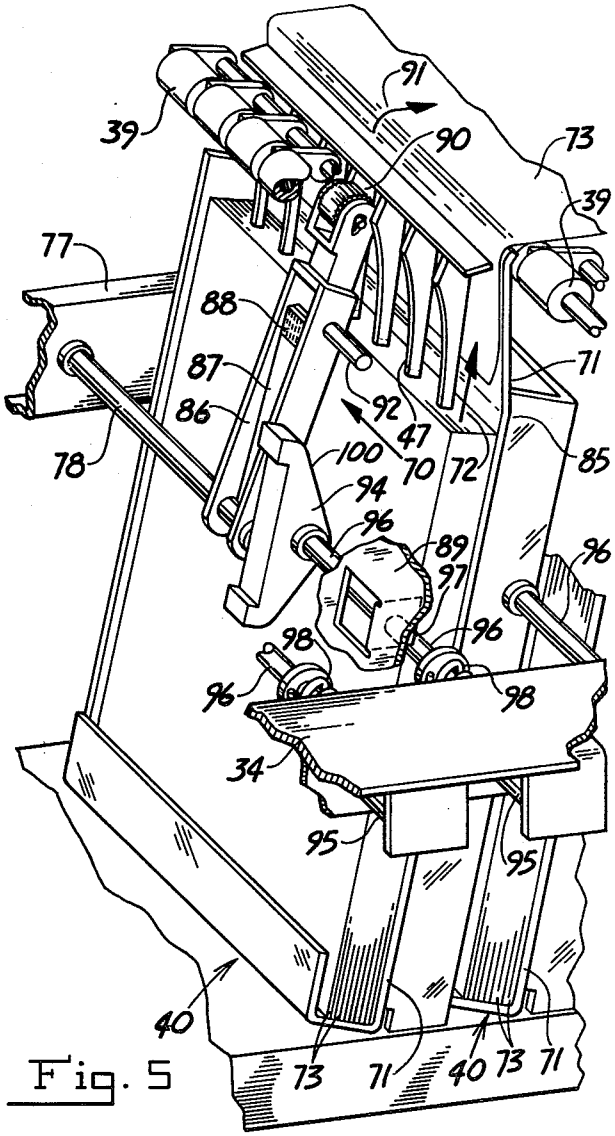
FIG. 5 is a partial perspective view of the typical discharge control feed mechanism depicted in FIG. 4, with the discharge control feed mechanism illustrated in an extended feeding position.

Sheets ejected from the bins 40 are pushed against the far wall 71 of the bin, and are exited from the gap 72 formed between the guide member 47 and the wall 71 (See FIGS. 2 and 5). When the sheet 73 (FIG. 5) reaches the top of the bin 40, it is caught in the bite between the overhead conveyor belt 36 (FIG. 2) and a subsequent feed roller 39, i.e. the feed roller 39 for the next successive bin 40. The sheet 73, now being under the influence of conveyor 36, is carried out the egress end 74 of the collasorter 10, as shown by arrows 75. The sheet 73 may be deposited in a stacking bin 76, or on a stacking deck (not shown), etc.

Figure 4:
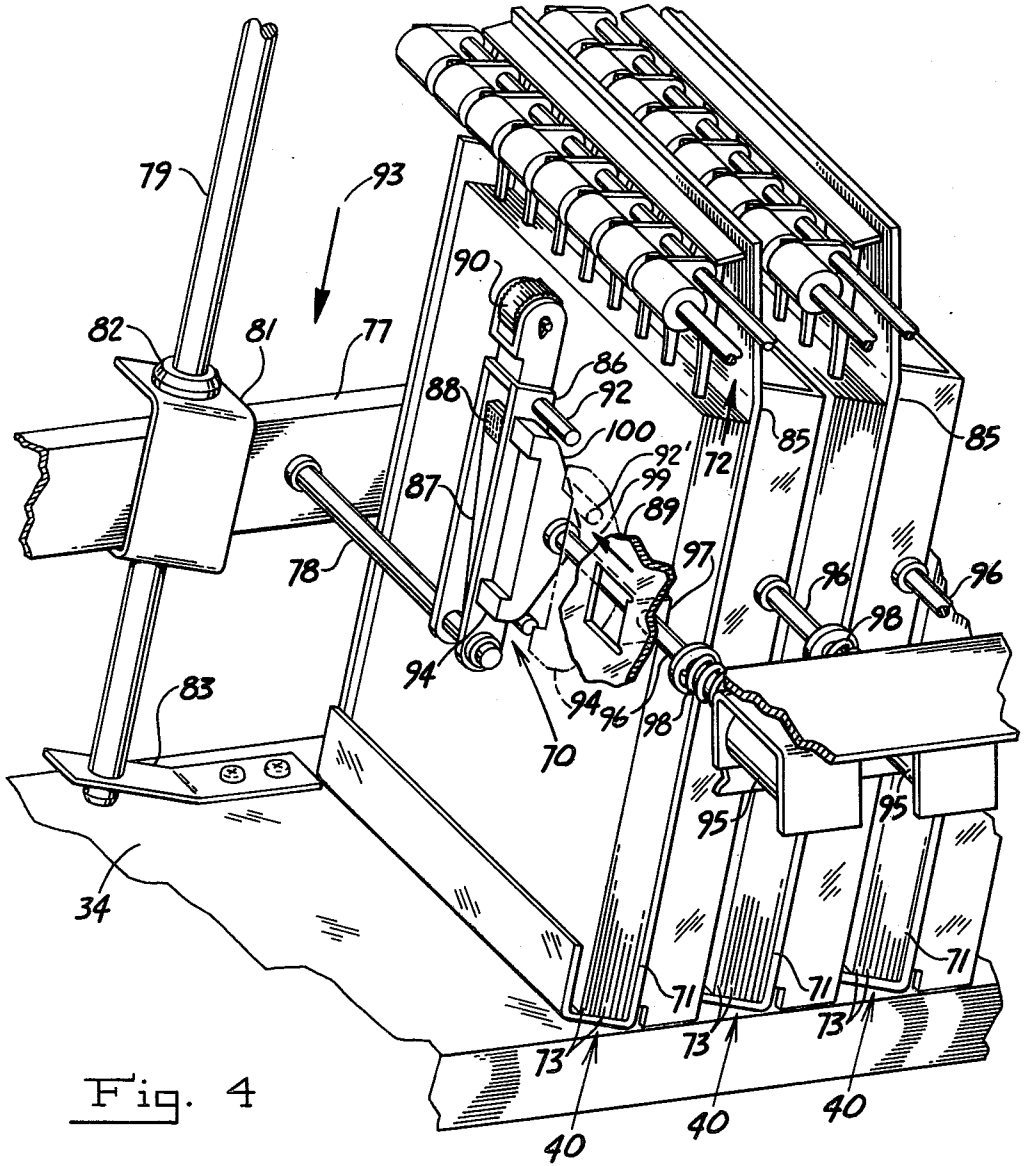
FIG. 4 is a partial perspective view of a typical discharge control feed mechanism for a bin of the combined collator-sorter shown in FIG. 2, wherein the discharge control feed mechanism is in a rest position.

Each of the pusher arms 70 are pivotably connected to a reciprocating vertically movable (arrow 84) rail 77 via a shaft 78, as illustrated in detail in FIGS. 4 and 5. The rail 77 is movably slidable upon, and guided by, two parallel rods 79 and 80, respectively (FIG. 2). These guide rods 79, 80 provide each push arm 70 with a precisely guided motion. In other words, the rail 77 has translatory motion, as seen by the phantom view of rail 77 in FIG. 2. Naturally, it is this parallelism which provides a smooth and proper ejection of the sheets 73 from the bins 40. Brackets 81, which are affixed to rail 77, have slidable bushings 82, which slide upon respective rods 79 and 80. The rods 79 and 80 are affixed to the main frame 34 by means of mounting angles 83 (FIGS. 2 and 4)

The pusher arm 70 as aforementioned, is pivotable on shaft 78, and allows the pusher arm 70 to retain a non-ejecting position when the bins are being filled. It also allows the pusher arm 70 to track against the far wall 71, when actuated to eject sheets 73. In other words, the pusher arm 70 will follow the contours of wall 71. As will be observed, this wall has a forward angle bend 85 at the upper portion thereof. The purpose of this forward bend will become more apparent with the following discussion of the operation of the pusher arm 70.

The pusher arm 70 comprises an elongated, hollow, U-shaped channel member 86 (FIGS. 4 and 5). A strip 87 is angularly fixed to the shaft 78 and disposed with the channel 86. A magnet 88 is carried on the upper portion of the strip 87. When the pusher arm 70 is retracted, i.e. when pusher arm 70 lies adjacent the forward wall 89 (FIG. 2), the magnet 88 holds the channel member 86 (made of iron) against strip 87. In this position, the channel member 86, and hence the pusher arm 70, will be held at the fixed angle of the stip 87, which angle parallels the wall 89. Thus, the pusher arm 70 will be held in a non-ejecting position, unless freed from the magnet 88, i.e. parallel and adjacent wall 89. This condition will prevail, even if the rail 77 continues to move up and down on guide rods 79 and 80. This is so, because the channel 86 remains latched to strip 87, despite moving up and down with the rail 77. The parallelism of the channel 86 with the forward wall 89 will insure an unimpeded movement of the channel 86 in the non-ejecting position.

The pusher arm 70 is actuated to a sheet ejecting position, by unlatching the channel 86 from the magnet 88 and strip 87. When this unlatching takes place, as will be explained hereinafter, the pusher arm 70 will be cammed toward the far wall 71 (back wall). The pusher arm 70 will be biased toward the rear wall 71 under the influence of gravity, i.e. the center of gravity of the pusher arm 70 is such that it will fall towards the back wall 71.

Sheets 73 in the bins 40 will rest against the back wall 71 due to the slant of the wall. Thus, the pusher arm 70 will contact the sheets 73, when it is biased towards tthe wall 71.

A fixed friction member 90, carried at the top of each pusher arm 70, will engage the inner-most sheet 73 in each bin, and push this sheet upwardly as the rail 77 and the pusher arms 70 move upwardly (arrow 84, FIG. 2). The sheet 73 will be ejected (arrow 91 of FIG. 5) out of the top of the bin 40 as typically shown in FIG. 5, when the rail 77 and the pusher arm 70 complete their upward travel. The rail 77, and hence the pusher arms 70, are then returned (arrow 93) to a lower position as shown in FIG. 4.

The last bin in FIG. 2, is designated 40', and shows in phantom several typical operating positions for a pusher arm 70. The rest or initial position for the pusher arm is shown in solid line corresponding to FIG. 2. The position of the pusher arm designated 70' illustrates the pusher arm in its early stages of upward travel after having been cammed towards wall 71. The position designated 70'' depicts the pusher arm at the height of its upward travel corresponding to FIG. 5.

It will be noted from FIGS. 2 and 5, that the bend 85 in wall 71 will cause the pusher arm 70 to move backwardly towards wall 89 as it proceeds in its upward movement. At the height of the pusher arm travel, the pusher arm 70 will be seen to be parallel with the forward wall 89. In this position, (designated 70'') the pusher arm will have its channel 86 relatched to magnet 88 and strip 87. Thus, on its travel back down the bin 40', the pusher arm will slide parallel to, or otherwise not interfere with, the remaining sheets in the bin.

The pusher arm 70 has a pin 92 adjacent the roller 90, which extends outwardly to come in contact with a camming block 94, when the pusher arm descends (arrow 93 of FIG. 4). The caming block 94 is used to disengage the magnet 88 from channel 86, as will be described in more detail hereinafter. The camming block 94 is connected to a pull solenoid 95 (in FIGS. 4 and 5) via shaft 96, which is an extension of the solenoid plunger. The shaft 96 and the attached camming block are supported in a braket 97 punched out of the wall 89. The solenoids 95 are secured to the main frame 34, and their plungers (shafts 96) are spring-loaded by means of coil springs 98. Solenoids 95 are continuously actuated to hold the camming blocks in the phantom position 94', (FIG. 4), when the bins 40 are being loaded. In this way, the channels 86 always remain latched during the loading, and hence, the pusher arms 70 never interfere with the loading of the bins.

However, when the sheets in bins 40 are to be discharged, the solenoids 95 are deactuated. Shafts 96 will move forwardly (arrow 99; FIG. 4) under the influence of the coil springs 98. Camming block 94 will now assume the position shown by the solid lines in FIG. 4. As aforementioned, the pin 92 will now contact the camming block 94 on the downward travel of the pusher arm 70. The pin 92 will come in contact with, and travel along, surface 100 of block 94. As the pusher arm 70 reaches its rest position as shown in FIG. 2, pin 92 will move down and across surface 100, and come to a dwell position shown in phantom as 92' in FIG. 4.

As pin 92 attains the 92' position, the channel 86 will become unlatched from magnet 88. The camming action of block 94 (surface 100) will force the channel 86 away from the angularly fixed strip 87, thus breaking the hold of magnet 88.

In this way, pusher arm 70 is cammed towards the rear wall 71 at the end of every down stroke, and is relatched at the height of every up stroke. In this manner, the pusher arm 70 is set to eject sheets 73 prior to every up stroke, and is relatched prior to every down stroke to clear, or otherwise non-interfere with, the remaining sheets 73.

The movement or translatory motion of the rail 77 may be imparted in many ways obvious to the skilled practitioner. For example, the rail 77 may be driven by a rotating cam with specifically designed rise and fall parameters.

Figure 7:
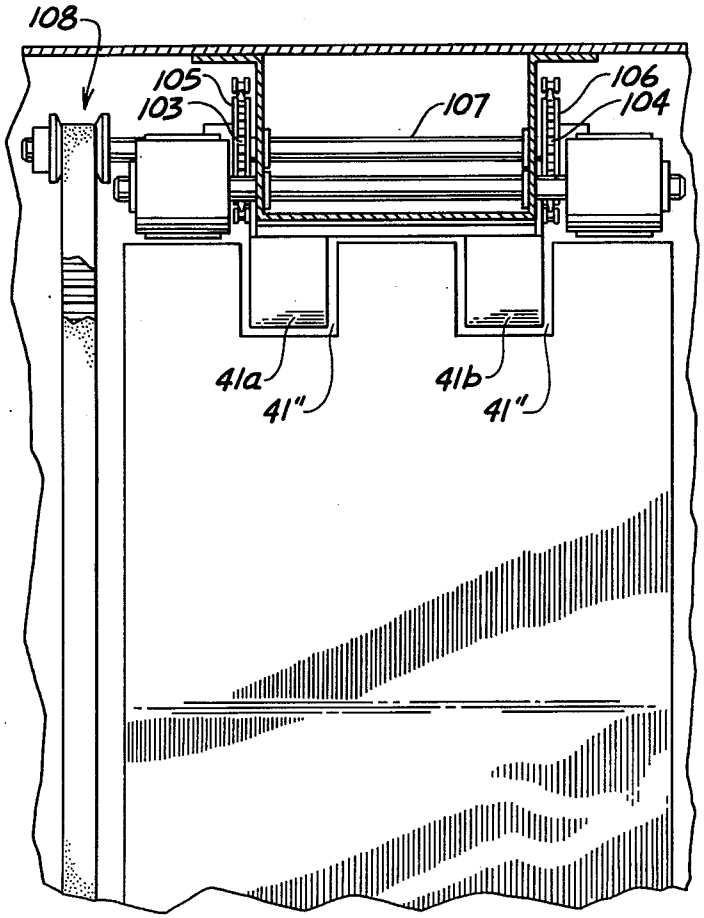
FIG. 7 is a sectional view of the alternate embodiment illustrated in FIG. 6, taken along lines 7—7.
Figure 6:
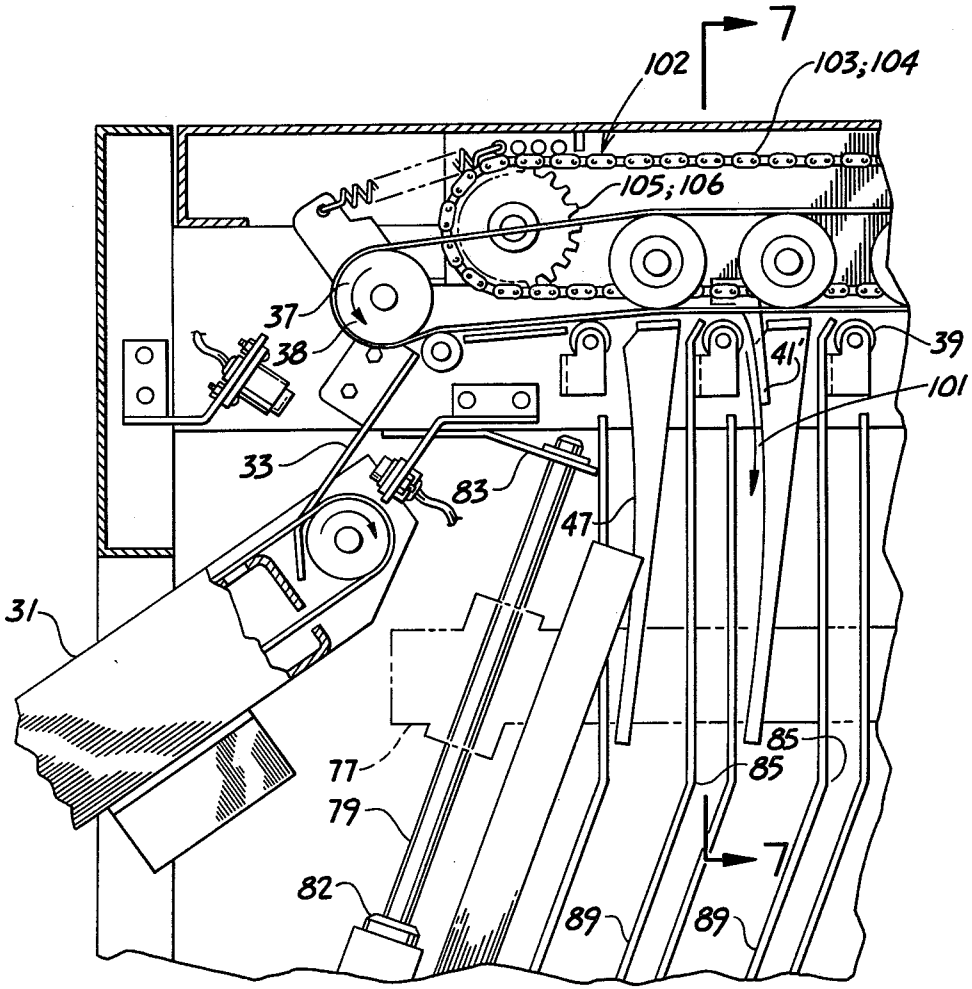
FIG. 6 is a partial side view of an alternate embodiment of the combined collator-sorter of this invention as depicted in FIG. 2.

Referring to FIGS. 6 and 7, an alternate embodiment is shown for the collator-sorter 10 of FIG. 2. In this embodiment, the deflectors 41 for each bin have been replaced by a single traveling deflector 41'. When a sheet is to be delivered to a particular bin, the deflector 41' is indexed adjacent the desired bin, and the sheet is deflected (arrow 101) therein.

The deflector 41' is comprised of two baffle plates 41*a* and 41*b* as shown in FIG. 7.

The deflector 41' is connected to, and is indexed adjacent each bin by means of a sprocket chain drive 102, comprising twin chains 103 and 104 driven by twin sprocket wheels 105 and 106 respectively. The other twin wheels of the chain drive are not shown. The sprocket wheels are integrally rotationally connected via shaft 107. The sprocket wheels 105 and 106 are rotated by the timing belt drive 108.

Figure 8:
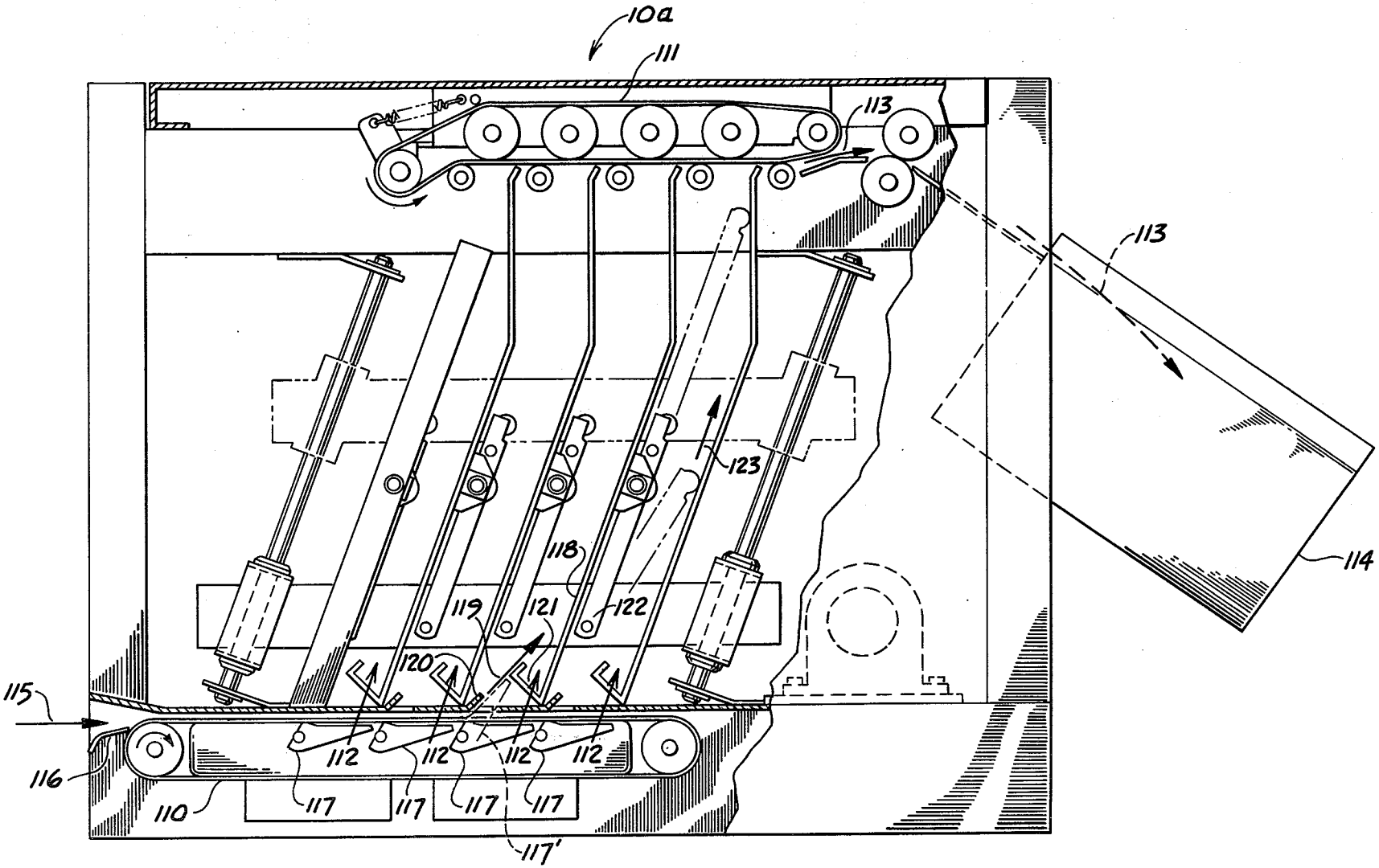
FIG. 8 is a side view of another alternate embodiment of the inventive combined collator and sorting apparatus of FIGS. 2 and 6.

Referring to FIG. 8 another alternate embodiment is shown for the inventive apparatus of FIG. 2. This embodiment illustrates a means of loading the collator-sorter from the bottom instead of from the top. This alternate collator-sorter, now designated 10*a*, has two conveyor belts 110 and 111, respectively. The upper conveyor belt 111 is strictly for transporting the sheets ejected from bins 112, and discharging these sheets (arrows 113) to a stacking bin 14.

The lower conveyor belt 110, is strictly for the purpose of delivering sheets to the bins 112. Sheets arriving (arrow 115) from a copier (not shown) are directed to the conveyor belt 110 by means of a guide plate 116. When each sheet arrives opposite its respective bin 112, a deflector 117 is caused to be pivoted in like fashion to the deflectors 41 shown in FIG. 3. The deflector 117' illustrated in phantom, shows a deflected (pivoted) position for a typical deflector 117. A sheet on conveyor 110 will be directed (arrow 119) by the deflector 117' against wall 118 of the bin 112. An angle bracket 120 oppositely and adjacently disposed from each deflector 117, provides an additional guiding surface for the deflected sheet.

Once directed into a respective bin 112, a sheet will stack within a well 121, which is an extension of the wall 118.

Each bin 112 has a sheet ejecting pusher arm 122, which is constructed and functions in the same fashion as the pusher arm 70 shown in FIG. 2. When the sheets are ejected (arrow 123), they are transported by the belt 111 to the stacker bin 114, as aforementioned.

In all respects, except those differences mentioned above, this collator-sorter 10*a* is designed and is operative in the same manner as the collator-sorter 10 shown in FIG. 2.

Figure 9:
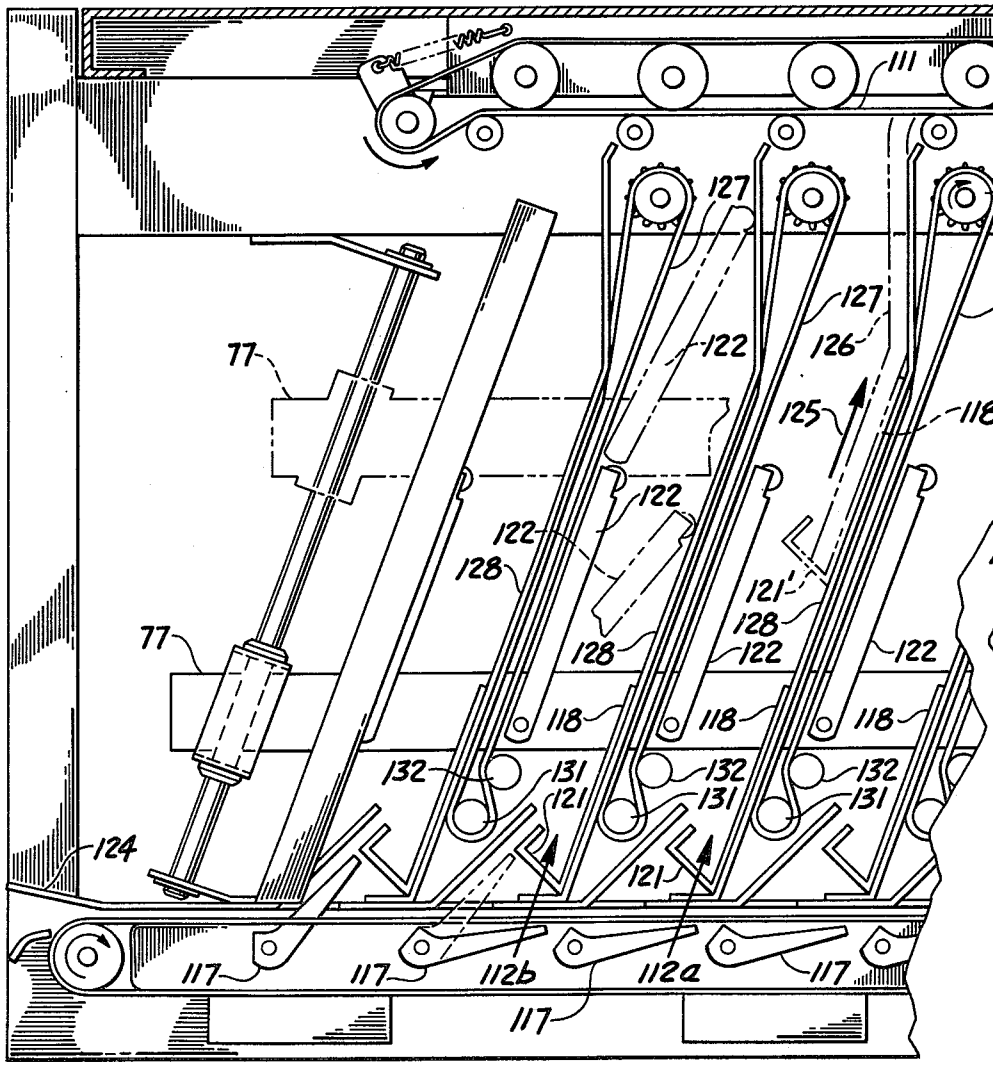
FIG. 9 is a partial side view of another embodiment of the invention shown in FIG. 8.

Referring to FIG. 9, an alternate embodiment of the collator-sorter 10*a* is shown, and is designated $10a_1$. This embodiment loads sheets from the bottom and discharges sheet from the top the same as collator-sorter 10*a*. The major difference between collasorters 10*a* and $10a_1$, is that the collator-sorter 10*a* has the additional capability of ejecting whole bundles of sheet material, as well as ejecting only individual sheets from each bin.

As will be observed, wall 118 is now of a shortened length, and is movably supported upon still another wall 128 secured to the frame 124 of the collator-sorter $10a_1$. The movable wall 118 again has a well 121 for supporting sheet material deposited therein. Wall 118 is slidable (arrow 125) in a vertical mode upon the fixed wall 128.

Wall 118 and the sheet holding well 121 are typically shown (in phantom view) in an extended, upper vertical position in the bin designated 112*a*. The upper phantomized elements have been designated 118' and 121' respectively. A phantom view of a bundle of sheets 126 is shown being supported by the wall 118' and the well 121'. When the wall 118 and well 121 reach their upper position as shown in phantom, the bundle of sheets 126 will be delivered to conveyor belt 111 for transportation to the stacking bin (not shown). Thus, it will be evident that all the sheets (bundle) can be ejected at one time by the movable wall 118 of each bin.

Naturally, each bin still has a single sheet ejection capability as provided by the pusher arm 122, respectively. As will be observed, with reference to bin 112*b*, a pusher arm 122 is shown (solid and phantom views) in various operative positions consistant with that previously depicted and described with reference to FIGS. 2, 4 and 5. Each pusher arm 122 will be biased as before, against the back wall of the bin, in this instance wall 128. Pusher arms 122 will be driven as before, by rail 77.

Figure 10:
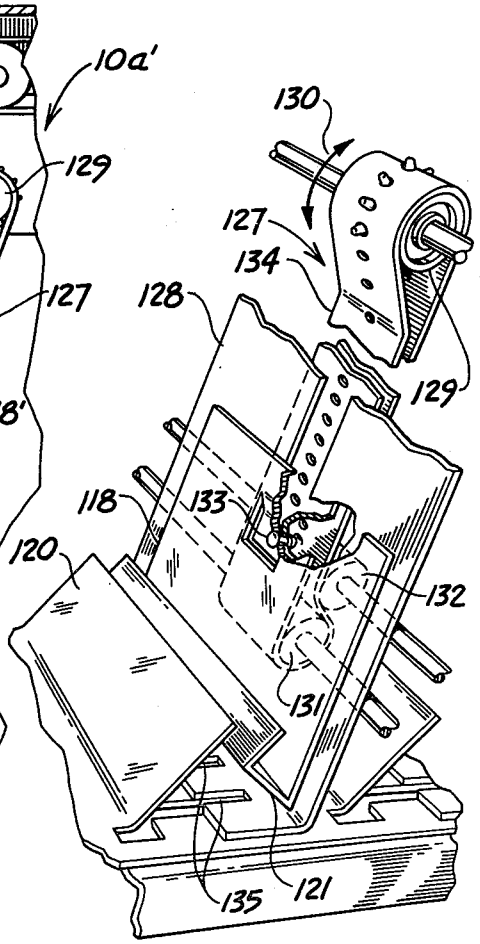
FIG. 10 is a partial perspective view of a portion of the embodiment illustrated in FIG. 9.

The movable walls 118 are each attached to and driven by a respective sprocket drive belt 127, which is partially illustrated in more detail in FIG. 10. The respective belts 127 are each driven by a sprocket wheel 129, which rotates in either a clockwise or a counterclockwise direction (arrows 130). The belts 127 are each supported for rotation by another sprocket wheel 131, which is shown at the bottom of each bin. A tensioning roller 132 is disposed opposite wheel 131 for keeping the belt 127 taunt.

When the wall member 118 is desired to be raised (arrow 125; FIG. 2) the sprocket wheel 129 is driven in a clockwise manner as shown in FIG. 2. To lower the wall member 118, the sprocket wheel 129 is reversed (driven counterclockwise). Each wall 118 is affixed to a respective drive belt 127 by any suitable fastener, such as a rivet pin 133 as depicted in FIG. 10. A slot 134 allows for the pinned wall 118 to be transported along wall 128.

Figure 11:
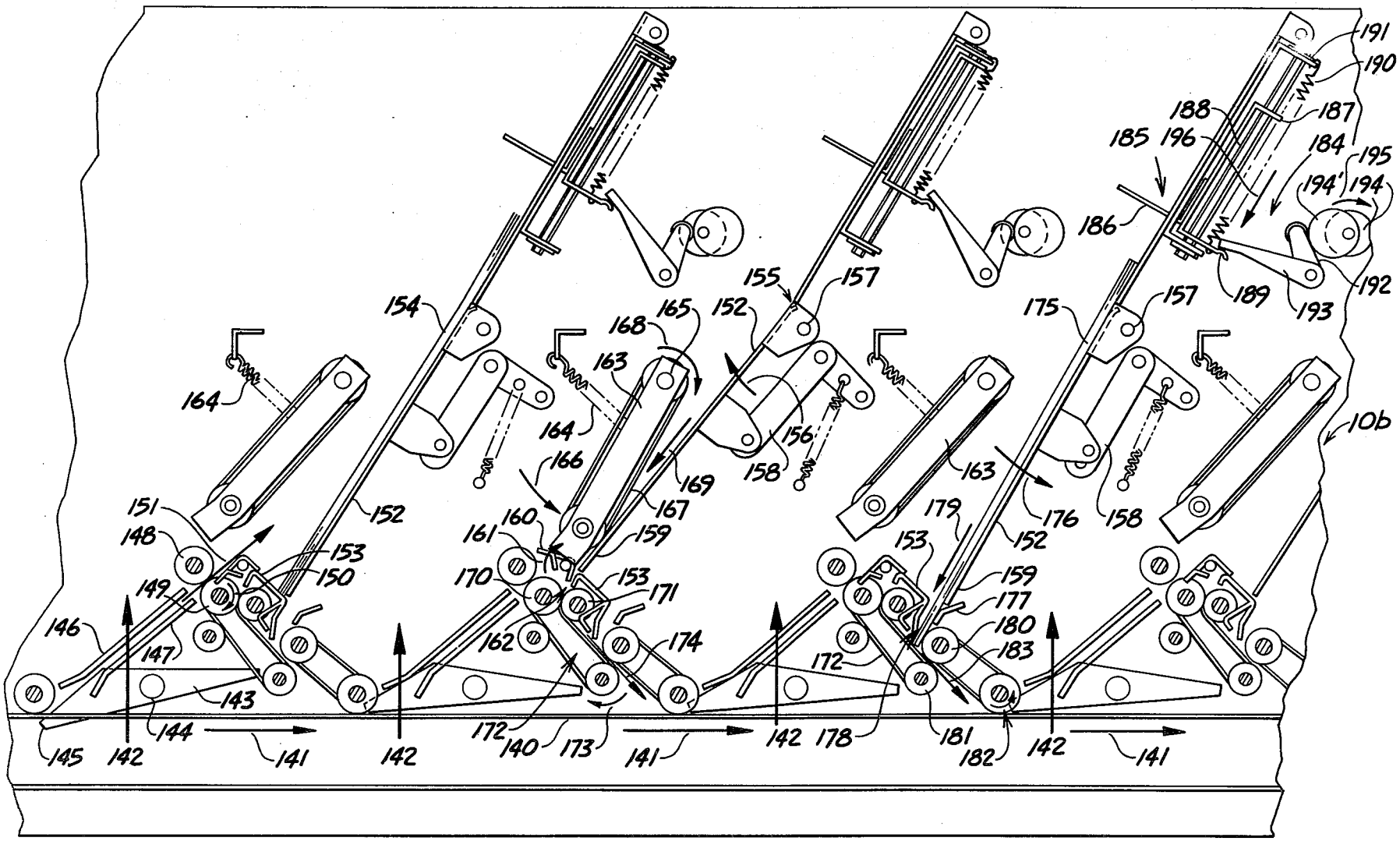
FIG. 11 is a partial side view of yet a further embodiment of the inventive combined collating and sorting apparatus depicted in FIGS. 2, 6, 8 and 9.

Now referring to FIG. 11, a bottom loading and a bottom ejecting collator-sorter 10*b* is depicted. This collator-sorter design embodiment has means for ejecting both single sheets and sheet bundles out the bottom of the machine.

A conveyor belt 140 delivers (arrow 141) sheets to the respective bins 142. Each bin 142 has a pivotable deflector 143 that pivots about its center shaft 144. The first bin 142 on the lefthand side, typically depicts a pivoted deflector 143 whose nose section 145 has been projected through slots (not shown) in the belt 140.

In this pivoted position, the deflector 143 will cause a sheet to be delivered between guide plates 146 and 147, and into the bite of rollers 148 and 149. Roller 149 is being driven (arrow 150) in a clockwise direction, thus causing the sheet to be propelled (arrow 151) against wall 152 of the bin.

An inclined bottom abutment member 153 receives (by gravity) each delivered sheet, and influences (by reason of its incline) each sheet to fall against the inclined wall 152 to form a stacked bundle 154, as shown.

The second bin 142 from the left typically illustrates how the sheets are individually ejected from the bin. It will be noted that the wall 152 is split into two sections about its midpoint 155. This allows the wall member 152 to pivot (arrow 156) about a pivot 157. The pivoting of the wall 152 is accomplished by means of a driven linkage 158. When the wall 152 is caused to pivot, the bottom 159 of the wall is made to slide past the upper most part of the abutment 153. An adjacent flange 160 is caused to pivot (arrow 161) by means of a solenoid (not shown), this forming a throated guide 162 for the downward traveling sheets.

The sheets are propelled towards the guide 162 by means of a small conveyor 163. The conveyor is normally held away from the wall 152 by means of a biasing spring 164 (see the first bin). The conveyor 163 is caused to be pivoted (arrow 166) about pivot 165 by means of a solenoid (not shown). This causes belt 167 of the conveyor 163 to be forced up against the sheets (not shown) resting against the wall 152. When the belt 167 of the conveyor 163 is caused to be driven (arrow 168) by conventional means, the sheets are ejected toward (arrow 169) the throated guide 162 in seriatim.

The guide 162 funnels the sheets to the bite of rollers 170 and 171, respectively. Roller 170 also forms part of a belted conveyor 172, which when driven (arrow 173) will propell (arrow 174) the sheets caught in the bite of rollers 170 and 171. The sheets conveyed by the conveyor 172 are then transported (arrow 141) from the collator-sorter by means of conveyor 140.

The third bin 142 from the left typically illustrates the capability of discharging a whole bundle of sheets 175 at one time from the bin. In this mode, the conveyor 163 remains in a non-pivoted position as previously shown in the first bin 142.

The wall 152 is now made to pivot backwards (arrow 176) about pivot 157, such that its lower end 159 pulls away from the lower end of the abutment 153, and moves adjacent stop member 177. This provides a guided throat area 178 formed between the wall 152, stop member 177 and abutment 153. The bundle of sheets 175 is now directed downwardly (arrow 179) through the throated area 178 into the bite between rollers 180 and 181. Roller 181 is part of conveyor 172, and roller 180 forms part of an adjacent conveyor 182. The bundle 175 will be directed by conveyors 172 and 182 towards (arrow 183) the takeaway belt 140, and transported (arrow 141) out of the machine.

A cammed mechanism 184 and a pusher device 185 assist or otherwise force feed the bundle 175 in its downward movement. This apparatus may be necessary where the bundle 175 is very thick.

The pusher device 185 comprises a pusher arm 186 which is affixed to a guided channel bar 187. The channel bar 187 and the pusher arm 185 are guided upon rod 188.

The lower leg 189 of channel 187 is connected to a spring 190 at one end thereof. The spring 190 is connected to the machine frame 191 at its other end.

The cammed mechanism 184 comprises a bell crank 192 whose lower arm 193 abuts against the lower channel leg 189. A cam 194 is caused to rotate (arrow 195) to the position designated as 194'. In this position, the arm 193 of bell crank 192 forces the leg 189 downwardly as shown (arrow 196). This in turn will cause the pusher arm 85 to force the bundle 175 downwardly. After the bundle is ejected, the cam is returned to its initial position 194. Then, the channel 187 and pusher arm 186 will return to their initial positions as shown in the first and second bins. This will be accomplished under the influence of the spring 190.

Figure 12:
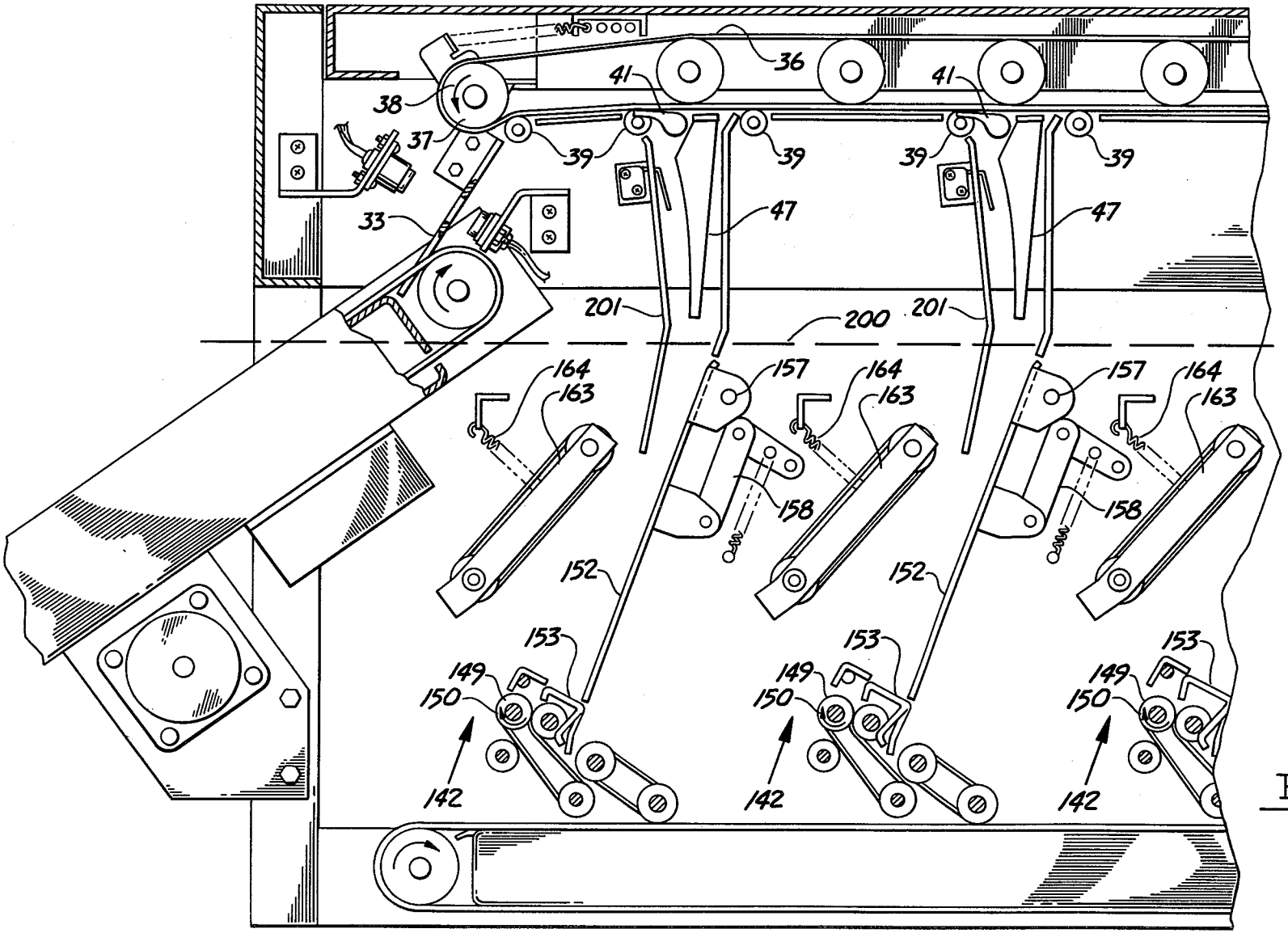
FIG. 12 is a partial side view of still another alternate embodiment of the invention, depicting a marriage between the collating and sorting apparatuses shown in FIGS. 2 and 11.

FIG. 12 illustrates a collator-sorter embodiment **10*c*, which features loading the sheets from the top of the machine and ejecting them out the bottom. As will be observed, the sheets are delivered to the respective bins 142 by means oof a conveyor belt 36 similar to that shown in FIG. 2. In fact, the upper half of the machine is almost identical to the collator-sorter embodiment 10 of FIG. 2. The lower portion of the collator-sorter 10*c* (below line 200) is almost identical to the collator-sorter 10*b* depicted in FIG. 11. Collator-sorter 10*c* can, therefore, be thought of as a marriage between the two collator-sorter embodiments of FIGS. 2 and 11**.

The only difference in the structure and function of upper half of the machine (above line 200), is that an added guide plate or baffle 201 has been added adjacent guide 47. The guide plate 201 has been added to insure that sheets entering the bins 142 will clear the conveyor mechanism 163, and come to rest against abutment 153 and wall 152.

The only other structural and functional difference in the machine **10*c*, is that the bulk feed pusher mechanism 185 (FIGS. 11) has been removed, so as not to interfere with the ingress of the sheets into each bin 142**.

Other than the two aforementioned modifications, collasorter **10*c*** will operate as described for the previous embodiments.

In summary, embodiments of the inventive collator-sorter have shown that the sheet ingress and egress from the receiving bins can be either from the top or bottom of the machine. In other words, there are four possibilities for the sheet flow: (a) top loading and ejecting; (b) bottom loading and ejecting; (c) bottom loading and ejecting from the top of the machine; and (d) top loading and ejecting the sheets from the bottom of the machine.

The various embodiments have not necessarily shown all the features of the other alternate designs, but this only has been for the sake of brevity. For example, the embodiment **10*c* depicted in FIG. 12 may feature a bulk ejector 185. In such a case the pusher mechanism 185 would have to be made pivotable, so as to pivot out of the way when the sheets are being delivered. The pusher device 185** could be pivotably controlled by a solenoid, which would position the pusher device into an ejecting position after the sheets have been delivered to the bins.

DISCUSSION OF THE CONTROL SYSTEM

Before describing the control system circuitry, it will be necessary to define a few terms:

(a) "page run" or "page run cycle" is that portion of the collating or sorting operation wherein a single page, for example page 6, of a booklet is being deposited in the bin(s). For the sorting mode, each page 6 will be deposited in each respective bin selected. In the collating mode, all the pages 6 will be deposited in the sixth bin.

(b) "sheet count" is the number of sheets being counted during a page run cycle.

(c) "select count" is the number of bins or sheets that are selected to be deposited during each page run cycle.

(d) "high and low signals" are generally designated by the numbers "1" and "0", respectively. However, it is well known that the logic can easily be inverted to provide a complement of signals using low signals in place of high signals and vice versa.

FIG. 13 is an electrical schematic depicting the control logic necessary to operate the collator-sorter in either of the two modes: sorting or collating. The circuitry of FIG. 13 will be explained with reference to, and in conjunction with the collator-sorter embodiment shown in FIG. 2. However, it should be understood that all the aforementioned embodiments can use similar control circuitry. The circuitry of FIG. 13 can be changed to accommodate the other embodiments. The changes in the circuitry necessitated by the different embodiments are easily within engineering skill, and merely require the actuation or deactuation of various other control solenoids. The actuation or deactuation of these other controls will follow the logic pattern of the circuit illustrated in FIG. 13, as will hereinafter be explained.

In a sorting mode, let us assume that there are ten bins 40 (FIG. 2), into which it is desired to feed a quantity of sheets to make ten booklets. One sheet of each page of the booklet will be deposited in sequential order into each bin, until all the pages of the booklet are received in each bin. The sheets are fed to the inlet 32 of the collasorter 10. A photodetector device is located at the inlet 32. It is comprised of a light source 32*a* and a phototransistor 32*b*. A high signal is given whenever a sheet blocks the light path to the phototransistor 32*b*, such that a running sheet count may be obtained. If each one of the bins 40 is to receive a page in each run, the deflectors 41 must be sequentially operated for each run. This is achieved by the auto load/sort control logic 215 illustrated in FIGS. 13 and 13*a*. The high signal from the sheet detector 32*a*, 32*b* is transmitted to the auto load/sort control logic 215 along line 216 to input "C". The control logic 215 also receives a high signal along line 217 at input "A" from the sort/collate decoder 218. The decoder 218 has been set for the maximum number of bins, in this case ten. The decoder 218 will give a high signal for any number of sheets up to the bin maximum. In the collate mode, which will be explained hereinafter, the decoder 218 will give a low signal, signifying that more sheets than the maximum number of bins has been selected.

The sort/collate decoder 218 is comprised of a few NOR and NAND gates illustrated in FIG. 13*c*, which are designed to follow the truth table shown in FIG. 13*d*.

The decoder 218 output is the result of selecting tthe desired number of sheets using the copy count select thumbwheel 219 (FIGS. 2 and 13). The thumbwheel 219 will furnish the input to the decoder 218 along line 220 such that the control logic 215 will receive either a high or low signal at input "A".

The thumbwheel select signal will also furnish an input to a sheet count comparator 221, whose function is to compare the "running count" of the sheets in each run with the "select count". When the two counts show an equality, it is an indication that a new "page run" should be initiated, i.e. the next page of the booklet should be fed into each bin.

However, as each bin is filling during a page run in the sort mode, it is seen that a high signal will be received at input "C" of control logic 215 every time a sheet passes the photodetector 32*b*, and a standing high signal will be received at input "A" of control logic 215.

The control logic 215 is shown in more detail in FIG. 13*a*, and its operation will be explained with reference to the truth table in FIG. 13*b*.

The signals at inputs "A" and "C" are directed to NOR gates 222 and 223, respectively. The outputs of NOR gates 222 and 223 are fed to NOR gate 224, which supplies a signal at output "W". NOR Gates 225, 226 and 227 do not produce any output signals "X", "Y" or "Z" as can be seen from the truth table of FIG. 13*b* on line 6.

Therefore, every time a sheet passes photodetector 32*b*, a signal will be outputted at "W". The "W" signal will be sent over line 230 to the stepper 231, which successively actuates the individual solenoids 57 (FIG. 3) which respectively control each deflector 41.

Thus, it will be observed that every time a sheet passes photodetector 32*b* during a "page run" in the sort mode, the next deflector 41 will be activated.

It should be understood that whether the last bin 40 of the array of bins is filled first in a backwards progression (10, 9, 8, 7, etc.), or the first bin is filled first in a forward progression (1, 2, 3, 4, etc.), it will make no difference in the final result. It will make a difference, however, in whether the deflectors 41 are in an initial "up" (deflecting) position, or in a "down" (non-deflecting) position.

Figure 3:
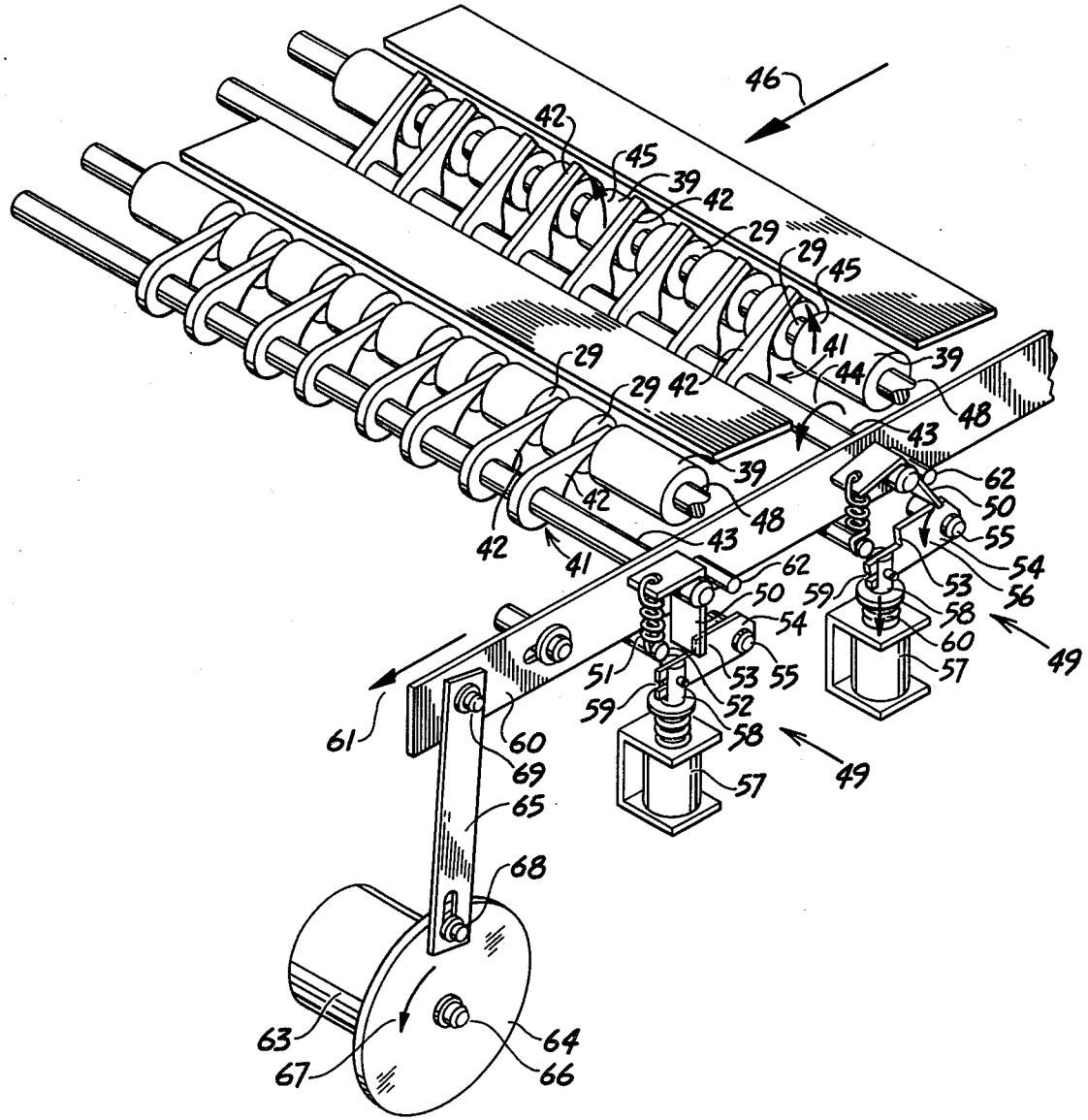
FIG. 3 is a partial perspective view of the deflector control mechanism for the combined collator-sorter illustrated in FIG. 2, depicting one bin deflector in a deflecting position, and another bin deflector in a non-deflecting position.

How the bins are to be filled, i.e., either right-to-left, or left-to-right, is strictly a matter of choice. The machine 10 can be easily designed to operate in either or both sequential modes. The machine 10 is shown in FIG. 3 to operate from right-to-left, starting with the last bin first.

When a "page run" is completed, all the deflectors 41 must be reset by actuating motor 63 (FIGS. 3 and 13) to pull rod 60. Also, the stepper control 231 of FIG. 13 must also be reset to allow for the successive actuation of each solenoid 57. This is accomplished by means of counter 232 (FIG. 13).

When a sheet of any "page run" moves past detector 32*b*, a counter 232 which has been counting each sheet of the run, sends a signal to the comparator 221 via line 233. The counter 232 receives a signal each time a sheet passes detector 32*b*, via the "count input" OR gate 234.

The comparator receives a "select count" signal from thumbwheels 219 via line 220, and the "sheet count" signal from counter 232 via line 233. The comparator compares these two signals, and if there is an equality, will provide a high signal to input "B" of control logic 215. This condition will only take place, however, when the last sheet of every "page run" moves past detector 32*b*.

When a high signal is on all the inputs "A", "B" and "C", NOR gates 222, 228 and 223, will respectively cause output signals to be delivered by NOR gates 225, 226 and 227 (FIG. 13*a*).

Referring to the truth table of FIG. 13*b*, line 8, high inputs "A", "B" and "C", will cause outputs at "W", "X" and "Y" of control logic 215.

The "X" output will provide a counter reset pulse to reset counter 232, via line 236. The counter 232 is reset to start counting from the beginning for the next run.

The "W" output actuates the stepper 231 to operate the last deflector solenoid 57.

The "Y" output provides a stepper reset pulse via line 237 to return the stepper control 231 to its home position, and to actuate motor 63 via a power relay 238, to pull rod 60 (FIG. 3). As will be seen, the "Y" reset pulse is delayed via delay 239. This delay allows for the last deflector to be set by the "W" signal, before the motor 63 clears all the deflectors, and it also allows the last sheet enough time to be deposited into the final bin (conveyor delay). Should the final bin to be filled be bin number 10, the conveyor delay will be much longer than when the final bin 40 is bin number one.

The "Y" reset pulse 240, while providing a reset pulse to line 237, will also provide a reset signal to the relay latch 241 via line 242. This will allow the next "Y" output (at the end of the next "page run") to again provide a reset pulse to line 237.

The first sheet of the next page run will now start the page run cycle all over again. There will be a series of "W" outputs to continuously step (stepper 231) te deflector solenoids 57, until the last page of the page run cycle initiates still another (new) page run cycle.

When it is desired to obtain more than ten booklets, the collate mode of operation for machine 10 will be selected.

The sort mode will not accommodate this number of booklets, because there are only ten bins 40 in the present example.

Naturally, the present invention is not limited to any particular number of bins. It has been estimated, however, that the number of bins for the average user should be somewhere in the range from 10 to 15.

When the collate mode is desired (as when more booklets are needed than the number of bins available), the decoder 218) will provide a low signal to input "A" of control logic 215. The input to "B" will be low, except for the last sheet of a "page run", and the input "C" will go high with each passing of a sheet before detector 32*b*. It should be noted that for the collate mode, the "page run cycle" referred to above, now stands for the number of sheets of each page deposited into its respective bin, i.e. all of pages one in bin 10, all of pages two in bin 9, all of pages three in bin 8, etc.

Because in the collate mode, "A" is always low, the high "C" input for each sheet in a page run will provide a "Z" output (high signal on the output of NOR gate 227, FIG. 13*a*). This will be seen to be true, with reference to the truth table of FIG. 13*b*, line 2.

The "Z" output (FIG. 13) of the control logic will provide only one step pulse to the stepper control 231 via line 230 throughout each page run. The Normally Closed relay 243 will become latched open with the first "Z" output ssignal. All subsequent "Z" output signals in the page run will, therefore, provide no stepping signal to stepper control 231 via line 230 and step pulser 244.

When the last sheet of a page run is obtained, the comparator 221 will compare the "sheet count" of counter 232 with the "select count" of the selector switches 219 and will find an equality. The "B" input will go high, and the condition in line 4 of the truth table (FIG. 13*b*) will be evidenced.

An output will now obtain on "X" and "Z" of control logic 215.

The "X" output will provide a reset signal to the counter 232 via line 236, to provide for the next page run. The counter reset pulse, which is provided by pulser 245, also provides a pulse to reset relay 243 via line 246. Therefore, when the first sheet of the next page run provides a "Z" output, the next deflector solenoid 57 will be actuated. This will continue until all the selected bins are filled.

Now, when the sheets are desired to be ejected in collated sets from the bins, another bin selector thunbwheel 250 (FIGS. 2 and 13) is dialed to engage the correct number of pusher arm solenoids 95 (FIGS. 4, 5, and 13).

A collate start switch 251 (FIGS. 2 and 13) is depressed. Latching logic or other suitable holding circuit means 252 is activated. This collating latching logic 252 will supply a signal to power relays 212 and 213. An ON/OFF switch 210 causes the power supply 211 to supply power to the power relays 212, 213, and 238, respectively.

When power relays 212 and 213 receive the signal from the latching logic 252, they will activate motors 253 and 263 which in turn will move the rail 77 (via a rotatable cam) and conveyor 36 (FIG. 2).

The collate latching logic 252 will also supply a signal to engage the pusher arm solenoids 95 (FIGS. 4 and 5) via the solenoid drivers 255 and the bin selector thumbwheel 250 (FIGS. 2 and 13).

The latching logic 252 will supply still another signal to reset all the deflectors 41. This is an important control feature, because if any of the deflectors are in the "up" (deflecting) position when the sheets are ejected from the bins, then the machine 10 will become jammed. The reset signal is supplied to the reset relay 256 via line 258. The reset relay 256 will supply a signal to power relay 238 to actuate the one cycle deflector reset motor 63 (FIG. 3) via lines 257 and 237.

The reset relay 256 will also reset the counter 232 via line 260. The reset relay may also be actuated by a reset switch 270 (FIGS. 2 and 13).

The sort starting switch 271 (FIGS. 2 and 13) will cause the sort latching logic or holding circuit 262 to power the sort drive motor 263 via the power relay 213. The motor 263 will drive the conveyor 36, as aforementioned.

When either the collate start switch 251 is thrown, the stop circuit 273 will provide a stop signal to the sort latching circuit 262. Conversely, when the sort start switch 271 is thrown, a stop signal will be provided by the stop circuit 273 to the collating latch circuit 252. This will insure that if the machine 10 is operating in, or is set for the alternate mode, the change of mode will not cause any interference to develop. In the case of the collating mode, the rail 77 will be returned to the home position, before sorting will start.

Depressing the stop switch 272 (FIGS. 2 and 13) will cause the machine to cease its operation in either mode.

It is to be understood that other functions of the machine such as offset stacking of collations, stapling, stitching, jam and miss detection have not necessarily been shown or explained. These functions are easily within the skill of the engineer, and are not necessary for an understanding of the invention, i.e. operating machine 10 in either a collating or a sorting mode.

As aforementioned, the logic taught by circuit 215 (FIGS. 13 and 13*a*) can be employed with minor variations to control the other embodiments of the invention. For example, the embodiment of FIGS. 6 and 7 shows a traveling deflector 41' in place of the fixed deflectors 41 of FIG. 2. In this embodiment, the stepper 231 (FIG. 13) can be used to index the deflector drive chain mechanism, such that the deflector 41' will be progressively stopped adjacent each bin.

In the embodiment 10*a'* shown in FIGS. 9 and 10, the deflectors 117 and the pusher arms 122 can operate from the same circuitry shown for embodiment 10 of FIG. 2. The sprocket wheels 129 may be controlled and driven by a separate "bulk sheet" control switch and drive motors. The "bulk sheet" switch can be similar to a thumbwheel selector and a stepper control can actuate each motor to turn respective sprockets 129.

Naturally, many modifications will occur to the skilled practitioner consistant with the inventive purposes. Such changes are deemed to lie within the purview, limits, spirit and scope of the invention.

Having described the invention, what is desired to be protected by Letters Patent is presented by the appended claims.

What is claimed is:

1. A combined sorting and collating machine selectively operable in a plurality of modes of operation wherein a plurality of copy sheets are assembled into booklets said machine comprising:

a. means defining an infeed location and an outfeed location;

b. means defining a plurality of adjacent copy sheet receiving and storing bins operatively associated with said means defining said infeed location and said outfeed location;

c. conveyor means operatively associated with said plurality of bins for conveying copy sheets seriatim from said infeed location to said plurality of bins and for conveying copy sheets from said plurality of bins to said outfeed location;

d. movable copy sheet deflecting means disposed intermediate said conveyor means and said bins for deflecting copy sheets from said conveyor means into said bins;

e. a corresponding plurality of copy sheet feeding means operatively associated with said bins for ejecting copy sheets from said bins to said conveyor means for delivery to said outfeed end of said machine;

f. a first control means for actuating said copy sheet deflecting meahs to cause said copy sheet deflecting means to deflect copy sheets from said conveyor means into a predetermined number of bins for assembling a booklet in each predetermined bin, thereby defining a machine sorting mode in which the number of booklets corresponds to said predetermined number of bins;

g. a second control means for actuating said copy sheet feeding means to cause said copy sheet feeding means to eject sheets from a predetermined number of bins to said conveyor means for successively assembling booklets, thereby defining a machine collating mode in which the number of sheets in each booklet corresponds to said predetermined number of bins; and h. selector means operatively associated with both said first and second control means, respectively, for selecting which of said first or second control means is operable, whereby said machine is selectively operable in either said sorting mode or said collating mode of operation.

2. The combined sorting and collating machine of claim 1, wherein said means defining said plurality of adjacent copy sheet receiving and storing bins comprises a substantially horizontal array of substantially vertically oriented, adjacent bins disposed between said infeed location and said outfed location.

3. The combined sorting and collating machine of claim 2, wherein said conveyor means comprises conveyor belt means adjacent said horizontal array of bins for conveying copy sheets in one direction from said infeed location to preselected bins and for conveying copy sheets ejected from said bins in said one direction to said outfeed location.

4. The combined sorting and collating machine of claim 2 wherein said bins have two open ends, said copy sheet deflecting means being operable to deflect copy sheets from said conveyor means into one of said two open ends of said bins and said copy sheet feeding means being operable to feed copy sheets out of the other open end of said bins.

5. The combined sorting and collating machine of claim 4, wherein said conveyor means comprises first and second conveyor belts each disposed adjacent said horizontal array of bins at each respective open end of said bins, said first conveyor belt conveying copy sheets from said infeed location to said one end of said bins and said second conveyor belt conveying sheets ejected from said other end of said bins to said outfeed location.

6. The combined sorting and collating machine of claim 1, wherein said movable deflecting means comprises a traveling deflector which is indexably movable from bin to bin, and drive means for indexably moving said deflector adjacent a respective bin of said plurality of bins, whereby copy sheets being conveyed by said conveyor means are deflected into a respective bin of said plurality of bins.

7. The combined sorting and collating machine of claim 1, wherein said copy sheet feeding means comprises a plurality of pusher devices each disposed in a respective bin of said plurality of bins, for ejecting a bundle of copy sheets disposed therein.

8. A combined sorting and collating machine selectively operable in a plurality of modes of operation wherein a plurality of copy sheets are assembled into booklets said machine comprising:

a. means defining an infeed location and an outfeed location;

b. means defining a plurality of adjacent copy sheet receiving and storing bins each having an upper and lower end, said bins being disposed between said means defining said infeed and outfeed locations, said bins being arranged in a substantially horizontal array and each having a substantially vertical orientation;

c. a first conveyor means operatively associated with and disposed above and adjacent to said plurality of bins for conveying copy sheets seriatim from said infeed location into the upper ends of said plurality of bins, and a second conveyor means disposed below and adjacent to the bins for conveying copy sheets from the lower ends of said plurality of bins to said outfeed location;

d. movable sheet deflecting means disposed intermediate said first conveyor means and said bins for deflecting copy sheets from the first conveyor means into said bins;

e. a corresponding plurality of copy sheet feeding means operatively associated with said bins for ejecting copy sheets from said bins to said second conveyor means for delivery to said outfeed end of said machine;

f. a first control means for actuating said copy sheet deflecting means to cause said copy sheet deflecting means to deflect copy sheets from said first conveyor means into a predetermined number of bins for assembling a booklet in each predetermined bin thereby defining a machine sorting mode of operation in which the number of booklets corresponds to the said predetermined number of bins g. a second control means for actuating said sheet feeding means to cause said sheet feeding means to eject sheets from a predetermined number of bins to said second conveyor means for successively assembling booklets, thereby defining a machine collating mode of operation in which the number of sheets in each booket corresponds to said predetermined number of bins; and h. selector means operatively associated with both said first and second control means, respectively, for selecting which of said first or second control means is operable in either said sorting mode or said collating mode of operation.

9. A combined sorting and collating machine selectively operable in a plurality of modes of operation wherein a plurality of copy sheets are assembled into booklets, said machine comprising:

a. means defining an infeed location and an outfeed location;

b. means defining a plurality of adjacent copy sheet receiving and storing bins each having an upper and lower end, said bins being disposed between said means defining said infeed and outfeed locations, said bins being arranged in a substantially horizontal array and each having a substantially vertical orientation;

c. a first conveyor means and a second conveyor means operatively associated with said plurality of bins, said second conveyor means being disposed below and adjacent to said bins for conveying copy sheets seriatim from said infeed location to the lower ends of said plurality of bins, and said first conveyor means being disposed above and adjacent to the bins for conveying copy sheets from said upper ends of said plurality of bins to said outfeed location;

d. movable copy sheet deflecting means disposed intermediate said second conveyor means and said bins for deflecting copy sheets from said second conveyor means into said bins;

e. a corresponding plurality of copy sheet feeding means operatively associated with said bins for ejecting copy sheets from said bins to said first conveyor means for delivery to said outfeed end of said machine;

f. a first control means for actuating said copy sheet deflecting means to cause said sheet deflecting means to deflect copy sheets from said second conveyor means into a predetermined number of bins for assembling a boklet in each predetermined bin, thereby defining a machine sorting mode of operation in which the number of booklets corresponds to said predetermined number of bins;

g. a second control means for actuating said copy sheet feeding means to cause said copy sheet feeding means to eject copy sheets from a predetermined nunmber of bins to said first conveyor means for successively assembling booklets, thereby defining a collating mode of operation in which the number of copy sheets in each booklet corresponds to said predetermined number of bins; and h. selector means operatively associated with both said first and second control means, respectively, for selecting which of said first or second control means is operable, whereby said machine is selectively operable in either said sorting mode or said collating mode of operation.

10. A combined sorting and collating machine selectively operable in a plurality of modes of operation wherein a plurality of copy sheets are assembled into booklets, said machine comprising:

a. means defining an infeed location and an outfeed location;

b. means defining a plurality of adjacent copy sheet receiving and storing bins each having an upper and lower end, said bins being disposed between said means defining said infeed and outfeed locations, said bins being arranged in a substantially horizontal array and each having a substantially vertical orientation;

c. conveyor means operatively associated with and disposed above and adjacent to said plurality of bins for conveying copy sheets seriatim from said infeed location to said upper ends of said plurality of bins and for conveying copy sheets from said upper end of said plurality of bins to said outfeed location;

d. movable copy sheet deflecting means disposed intermediate said conveyor means and said bins for deflecting copy sheets from said conveyor means into said bins;

e. a corresponding plurality of copy sheet feeding means operatively associated with said bins for ejecting copy sheets from said bins to said conveyor means for delivery to said outfeed end of said machine;

f. a first control means for actuating said sheet deflecting means to cause said copy sheet deflecting means to deflect copy sheets from said conveyor means into a predetermined number of bins for assembling a booklet in each predetermined bin, thereby defining a machine sorting mode of operation in which the number of booklets corresponds to said predetermined number of bins;

g. a second control means for actuating said copy sheet feeding means to cause said copy sheet feeding means to eject copy sheets from a predetermined number of bins for successively assembling booklets, thereby defining a machine collating mode in which the number of copy sheets in each booklet corresponds to said predetermined number of bins; and h. selector means operatively associated with both said first and second control means, respectively, for selecting which of said first or second control means is operable, whereby said machine is selectively operable in either said sorting mode or said collating mode of operation.

11. A combined sorting and collating machine selectively operable in a plurality of modes of operation wherein a plurality of copy sheets are assembled into booklets, said machine comprising:

a. means defining an infeed location and an outfeed location;

b. means defining a plurality of adjacent copy sheet receiving and storing bins each having a top and bottom portion, said bins being disposed between said means defining said infeed and outfeed locations, said bins being arranged in a substantially horizontal array and each having a substantially vertical orientation;

c. conveyor means operatively associated with and disposed below and adjacent to said plurality of bins for conveying copy sheets seriatim from said infeed location to said bottom of said pluraity of bins and for conveying copy sheets from said bottom of said plurality of bins to said outfeed location;

d. movable copy sheet deflecting means disposed intermediate said conveyor means and said bins for deflecting copy sheets from said conveyor means into said bins;

e. a corresponding plurality of copy sheet feeding means operatively associated with said bins for ejecting copy sheets from said bins to said conveyor means for delivery to said outfeed end of said machine;

f. a first control means for actuating said copy sheet deflecting means to cause said copy sheet deflecting means to deflect copy sheets from said conveyor means into a predetermined number of bins for assembling a booklet in each prederrmined bin, thereby defining a machine sorting mode of operation in which the number of booklets corresponds to said predetermined number of bins;

g. a second control means for actuating said copy sheet feeding means to cause said copy sheet feeding means to eject copy sheets from a predetermined number of bins to said conveyor means for successively assembling booklets thereby defining a machine collating mode in which the number of copy sheets in each booklet corresponds to said predetermined number of bins; and h. selector means operatively associated with both said first and second control means, respectively, for selecting which of said first or second control means is operable, whereby said machine is selectively operable in either said sorting mode or said collating mode of operation.

12. A combined sorting and collating machine selectively operable in a plurality of modes of operation wherein a plurality of copy sheets are assembled into booklets, said machine comprising:

a plurality of bins for sorting copy sheets, means for feeding copy sheets into said bins and out of said bins, first control means operatively connected to said feeding means for causing said feeding means to feed copy sheets into a predetermined number of bins for assembling a booklet in each predetermined bin, thereby defining a machine sorting mode of operation in which the number of booklets corresponds to said predetermined number of bins, and second control means operatively connected to said feeding means for causing said feeding means to feed copy sheets out of a predetermined number of bins, for successively assembling booklets thereby defining a machine collating mode of operation in which the number of sheets in each booklet corresponds to said predetermined number of bits, and selector means operatively associated with both said first and second control means, respectively, for selecting which of said first or second control means is operable, whereby said machine is selectively operable in either said sorting mode or said collating mode of operation.

* * * * *